US012173493B2

(12) United States Patent
Jones

(10) Patent No.: US 12,173,493 B2
(45) Date of Patent: Dec. 24, 2024

(54) AUTOMATIC CLEANING SYSTEM FOR A TOILET

(71) Applicant: Essence Laurel Jones, Macon, GA (US)

(72) Inventor: Essence Laurel Jones, Macon, GA (US)

( * ) Notice: Subject to any disclaimer, the term of this patent is extended or adjusted under 35 U.S.C. 154(b) by 0 days.

(21) Appl. No.: 17/195,635

(22) Filed: Mar. 8, 2021

(65) Prior Publication Data

US 2021/0388590 A1 Dec. 16, 2021

Related U.S. Application Data

(60) Provisional application No. 62/958,320, filed on Jan. 8, 2020.

(51) Int. Cl.

| | |
|---|---|
| ***E03D 9/00*** | (2006.01) |
| ***E03D 11/11*** | (2006.01) |
| *A47K 13/30* | (2006.01) |

(52) U.S. Cl.

CPC ..... *E03D 9/005* (2013.01); *E03D 9/002* (2013.01); *E03D 11/11* (2013.01); *A47K 13/302* (2013.01)

(58) Field of Classification Search

CPC ..... A01K 63/10; A46B 13/04–06; A47K 13/302; A47K 3/281; E03D 9/00–002; E04H 1/1216

See application file for complete search history.

(56) References Cited

U.S. PATENT DOCUMENTS 3,381,312 A * 5/1968 Whitla ..... A47K 3/281 4/662
4,597,114 A * 7/1986 Paterlini ..... E03D 9/002 4/662

(Continued)

FOREIGN PATENT DOCUMENTS

CN 106436850 * 2/2017 ..... E03D 9/00
CN 107816100 * 3/2018 ..... A47K 13/302

(Continued)

*Primary Examiner* — David P Angwin
*Assistant Examiner* — Nicholas A Ros
(74) *Attorney, Agent, or Firm* — Incorporating Innovation LLC; Charlena Thorpe, Esq.

(57) ABSTRACT

Implementations of a self-cleaning toilet cleaner are provided. In some implementations, the self-cleaning toilet cleaner may comprise a housing, one or more reservoirs, a toilet opener, one or more exterior brushes, and one or more bowl brushes. In some implementations, the self-cleaning toilet cleaner may also comprise one or more lid brushes, one or more seat brushes, one or more fluid lines, and one or more fluid pumps. In some implementations, the self-cleaning toilet cleaner may also comprise one or more blowers, one or more operation pads, one or more operation motors, one or more sensors, and a computer system.

In some implementations, a method of using the self-cleaning toilet cleaner may comprise receiving a toilet into the self-cleaning toilet cleaner, cleaning one or more portions of the toilet with the respective brushes, and applying a fluid to further clean the portions of the toilet. In some implementations, the method may also comprise applying a fluid to rinse the one or more portions of the toilet, drying the one or more portions of the toilet by blowing air on the portions with the blower, and releasing the toilet from the self-cleaning toilet cleaner.

14 Claims, 26 Drawing Sheets

(56) References Cited

U.S. PATENT DOCUMENTS

| | | | | |
|---|---|---|---|---|
| 5,907,879 | A * | 6/1999 | Downey | A47L 11/4086 15/353 |
| 7,028,925 | B2 * | 4/2006 | Guest | A47L 11/4083 239/525 |
| 8,011,051 | B1 * | 9/2011 | Ba-Akeel | E03D 9/005 15/56 |
| 2013/0125335 | A1 * | 5/2013 | Robinson | A47L 5/365 15/320 |
| 2019/0246858 | A1 * | 8/2019 | Karasikov | A47L 9/2894 |
| 2020/0063423 | A1 * | 2/2020 | Bruno | A46B 13/02 |

FOREIGN PATENT DOCUMENTS

| | | | | |
|---|---|---|---|---|
| EP | 3415064 | * | 12/2018 | E03D 9/002 |
| FR | 3017887 | * | 8/2015 | A47K 13/24 |
| JP | H06287987 | * | 10/1994 | E03D 9/00 |
| JP | 2005248591 | * | 9/2005 | E03D 9/00 |

* cited by examiner

AUTOMATIC CLEANING SYSTEM FOR A TOILET

CROSS REFERENCE TO RELATED APPLICATION

This application claims the benefit of U.S. Patent Application Ser. No. 62/958,320, which was filed on Jan. 8, 2020, and is incorporated herein by reference in its entirety.

TECHNICAL FIELD

This disclosure relates to implementations of a self-cleaning toilet cleaner.

BACKGROUND

Toilets regularly become dirty, soiled, or otherwise in need of cleaning after normal usage, and even more quickly and frequently so when used during sickness, illness, or other circumstances. Usually the toilet bowl and/or the toilet seat of a toilet is cleaned in response to such need for cleaning, and sometimes part of the outer surface of the toilet is also or alternately cleaned. However, any such cleaning must be performed manually and usually involves less than half of the surfaces of the entire toilet. Furthermore, there does not exist a device that automatically/self-cleans an entire toilet, including the outer surfaces, the toilet seat, and the toilet bowl, or even part of a toilet.

DETAILED DESCRIPTION

Implementations of a self-cleaning toilet cleaner are provided. In some implementations, the self-cleaning toilet cleaner may comprise a housing, one or more reservoirs, a toilet opener, one or more exterior brushes, and one or more bowl brushes. In some implementations, the self-cleaning toilet cleaner may also comprise one or more lid brushes, one or more seat brushes, one or more fluid lines, and one or more fluid pumps. In some implementations, the self-cleaning toilet cleaner may also comprise one or more blowers, one or more operation pads, one or more operation motors, one or more sensors, and a computer system.

In some implementations, the self-cleaning toilet cleaner is configured to automatically clean or self-clean a toilet.

In some implementations, the self-cleaning toilet cleaner is configured to automatically clean or self-clean one or more portions of a toilet, such as the outer or exterior surfaces, the toilet lid, the toilet seat, and/or the toilet bowl. In some implementations, the self-cleaning toilet cleaner is configured to automatically clean or self-clean all of the portions of a toilet In some implementations, the self-cleaning toilet cleaner is configured to at least partly encapsulate or enclose a toilet to self-clean the toilet. In some implementations, the self-cleaning toilet cleaner is configured to fully encapsulate or enclose a toilet to self-clean the toilet.

In some implementations, a method of using the self-cleaning toilet cleaner may comprise receiving a toilet into the self-cleaning toilet cleaner, cleaning one or more portions of the toilet with the respective brushes, and applying a fluid to further clean the portions of the toilet. In some implementations, the method may also comprise applying a fluid to rinse the one or more portions of the toilet, drying the one or more portions of the toilet by blowing air on the portions with the blower, and releasing the toilet from the self-cleaning toilet cleaner.

FIGS. 1-26 illustrate implementations of an example self-cleaning toilet cleaner 100 according to the present disclosure. FIGS. 27-46 illustrate example use and operation of the self-cleaning toilet cleaner 100 according to the present disclosure.

Figure 1:
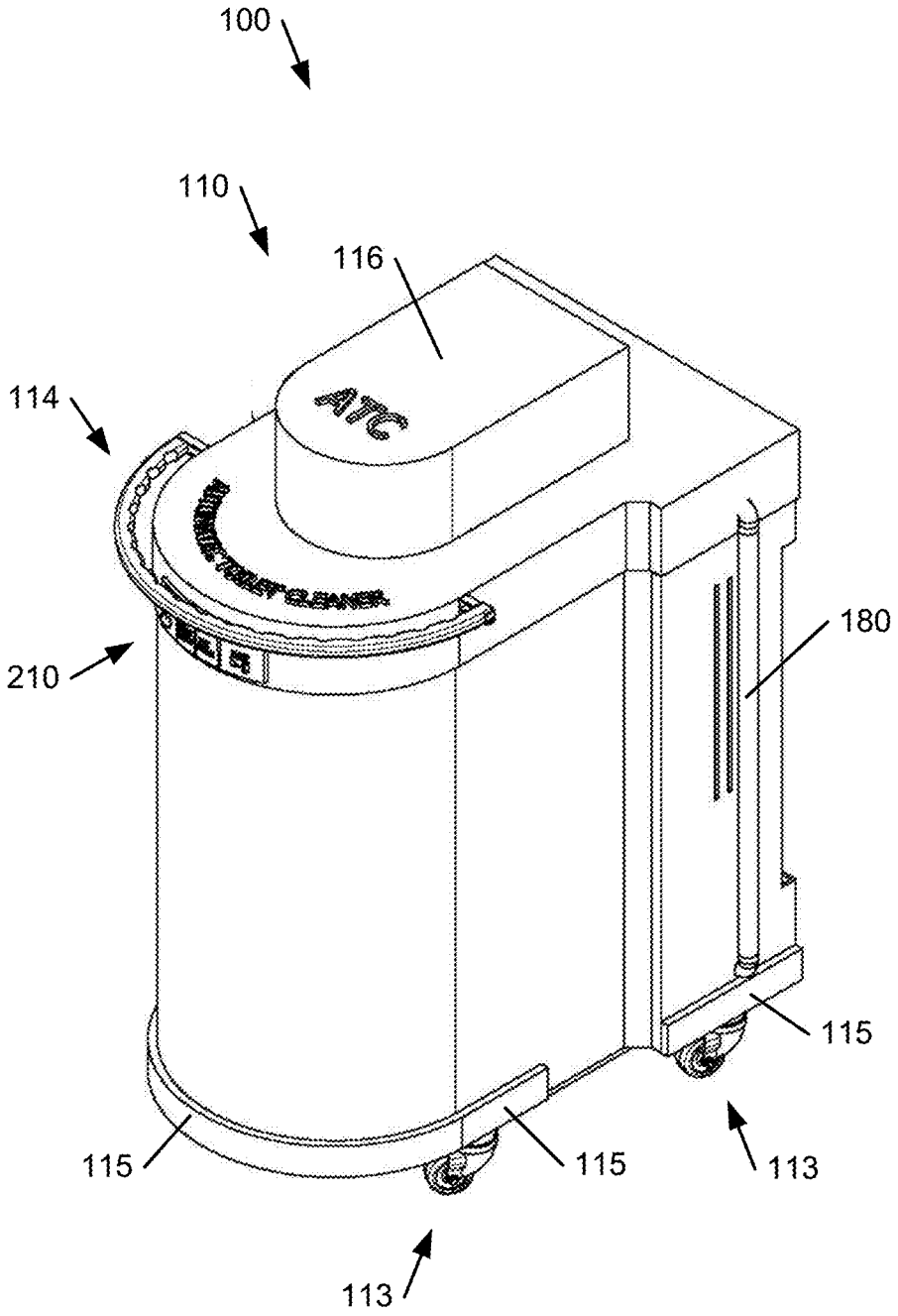
FIGS. 1-26 illustrate implementations of an example self-cleaning toilet cleaner according to the present disclosure.
Figure 5:
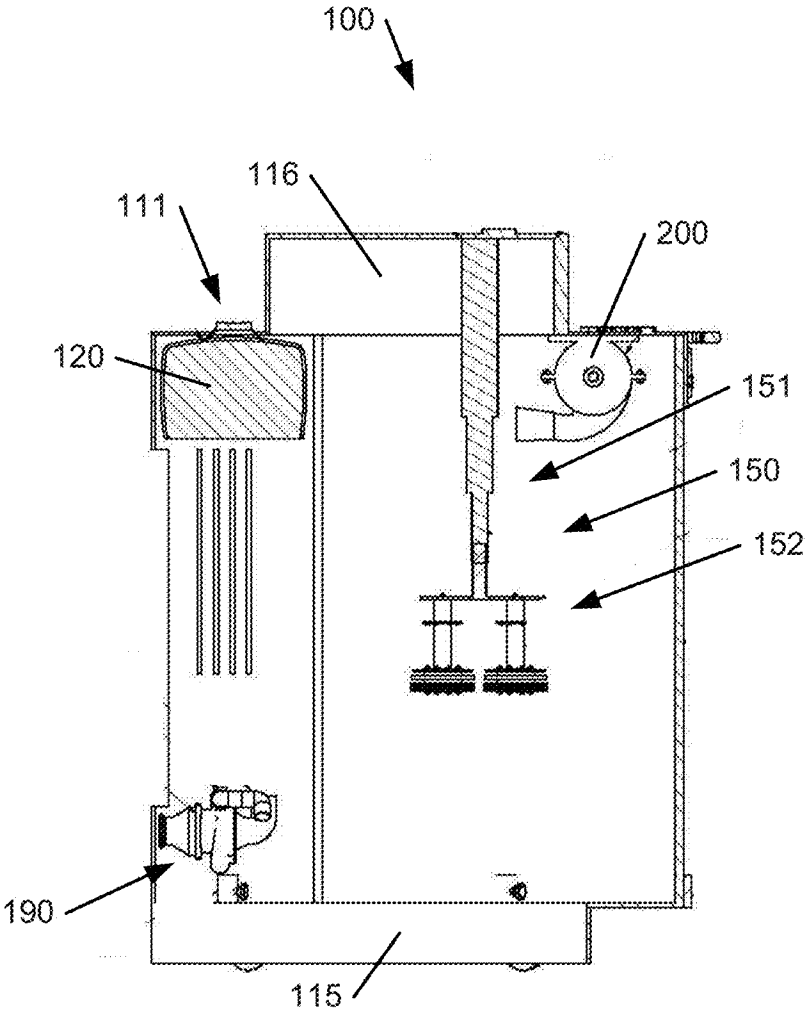
Figure 12:
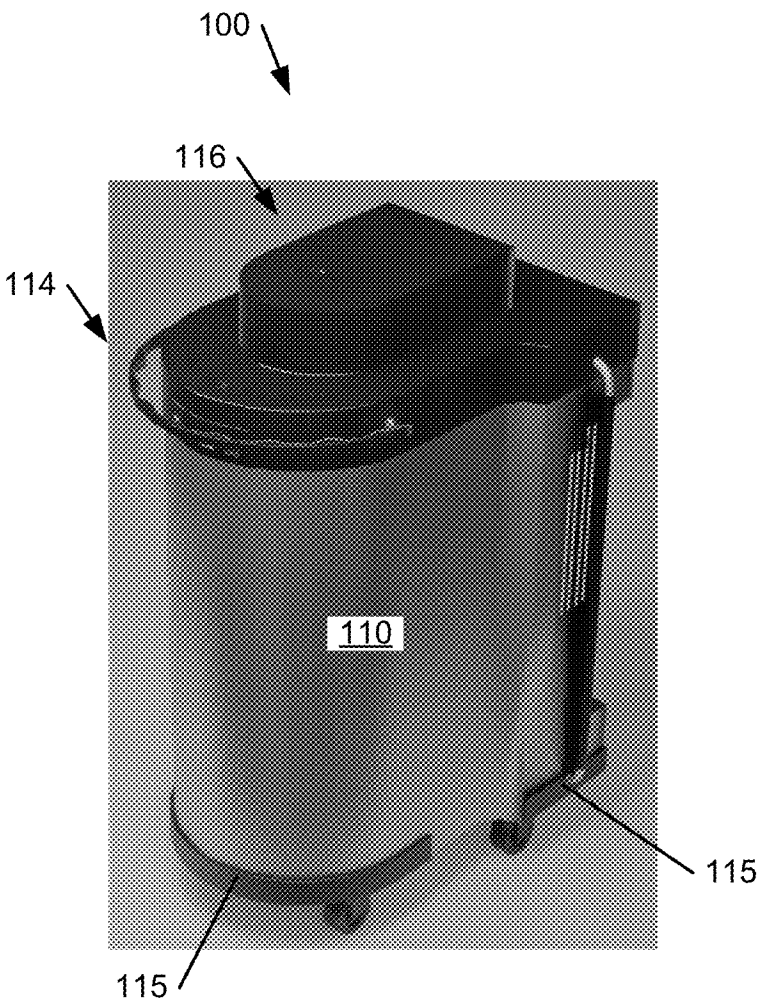
Figure 15:
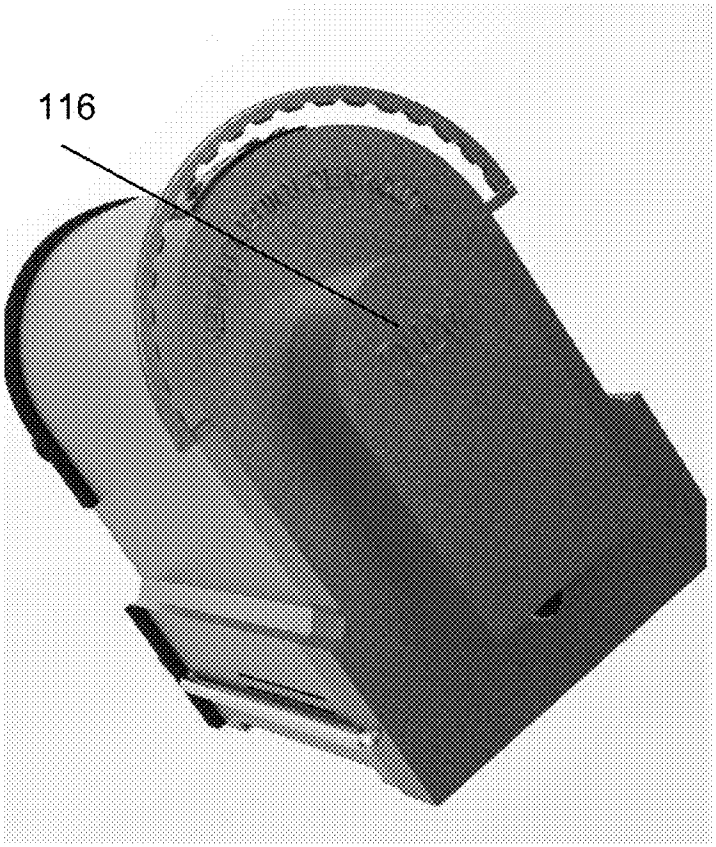
Figure 14:
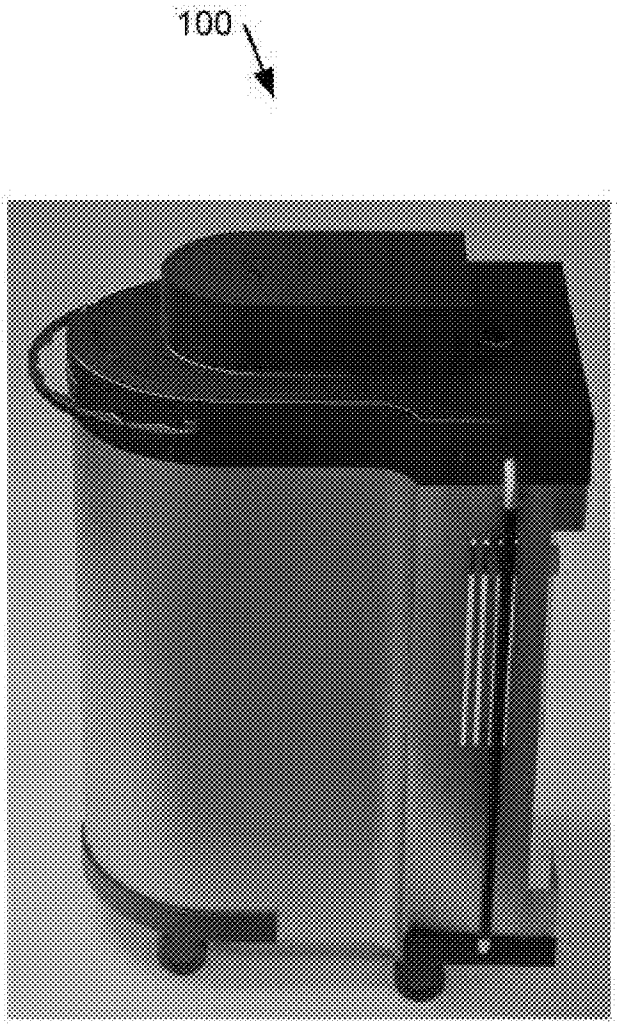
Figure 17:
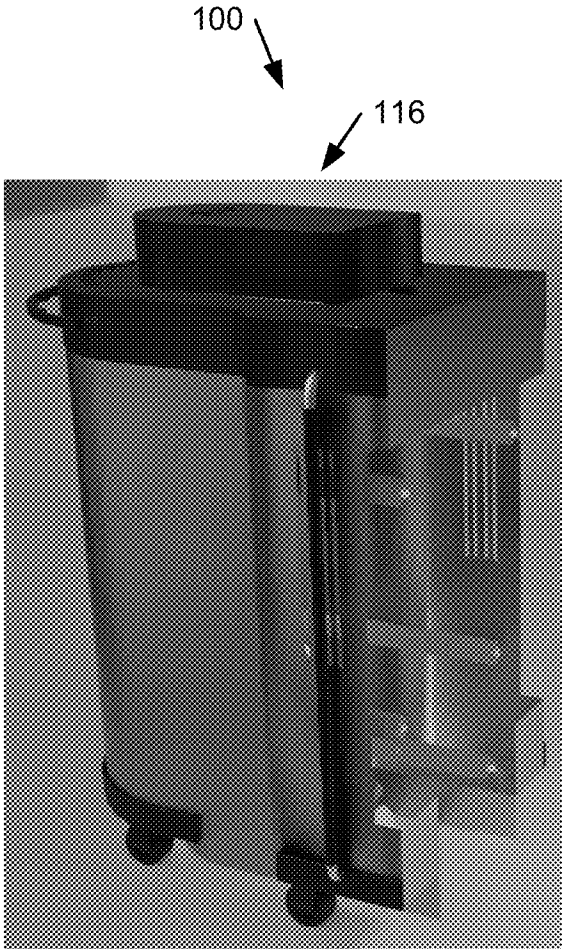
Figure 19:
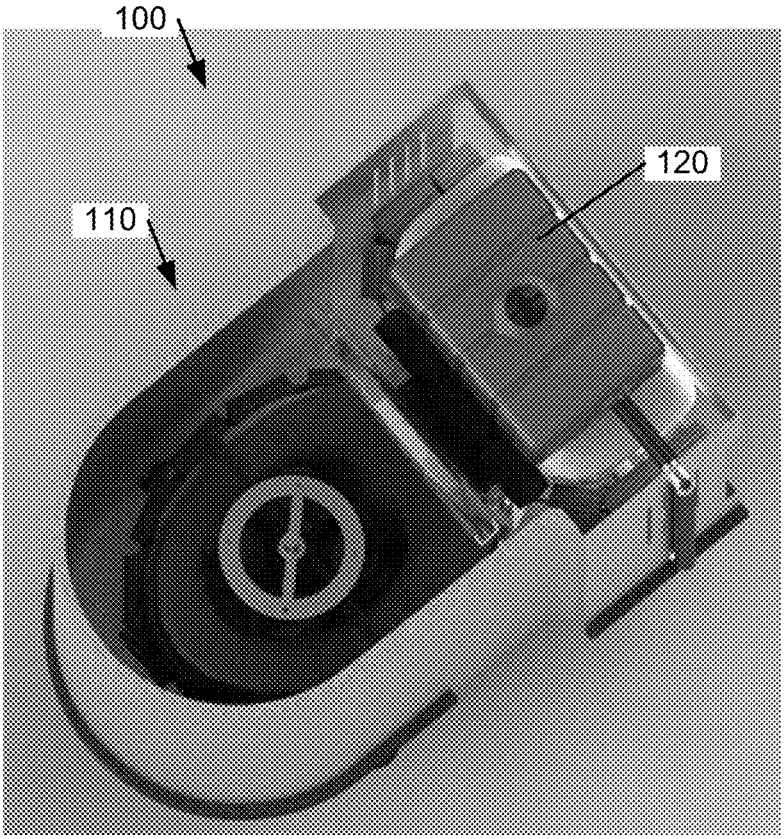
Figure 21:
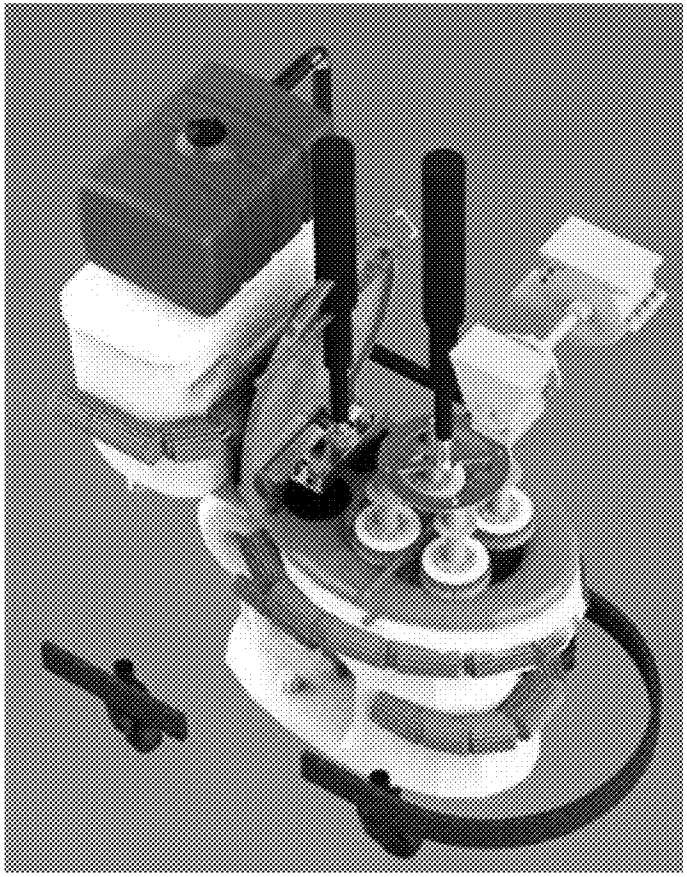
Figure 20:
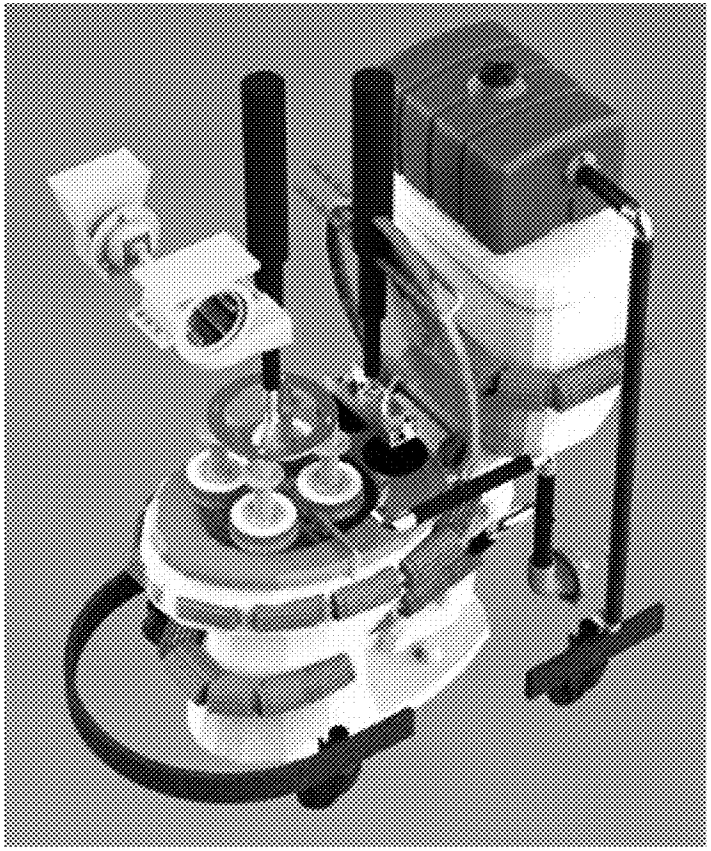
Figure 23:
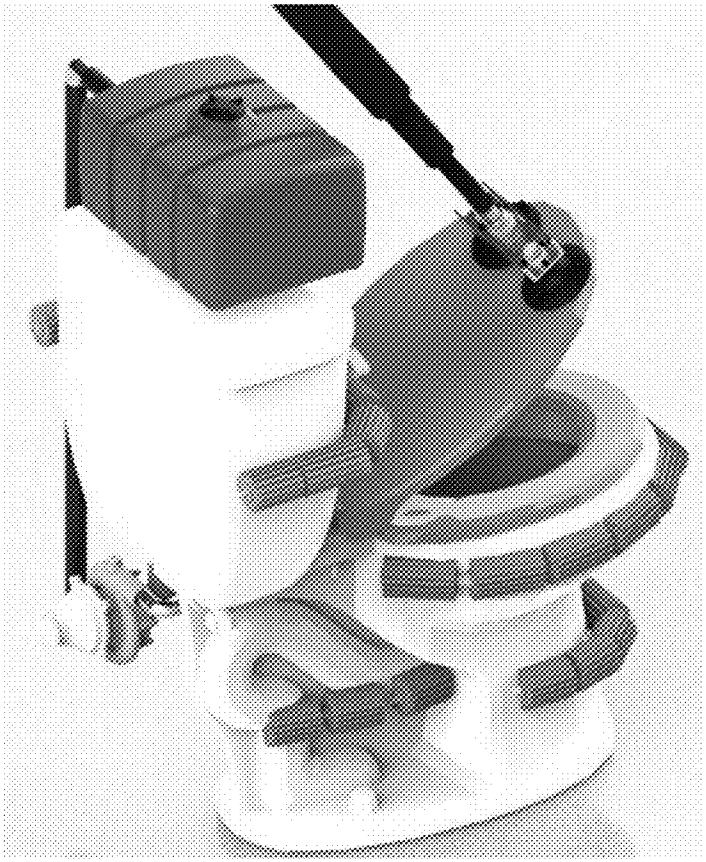
Figure 22:
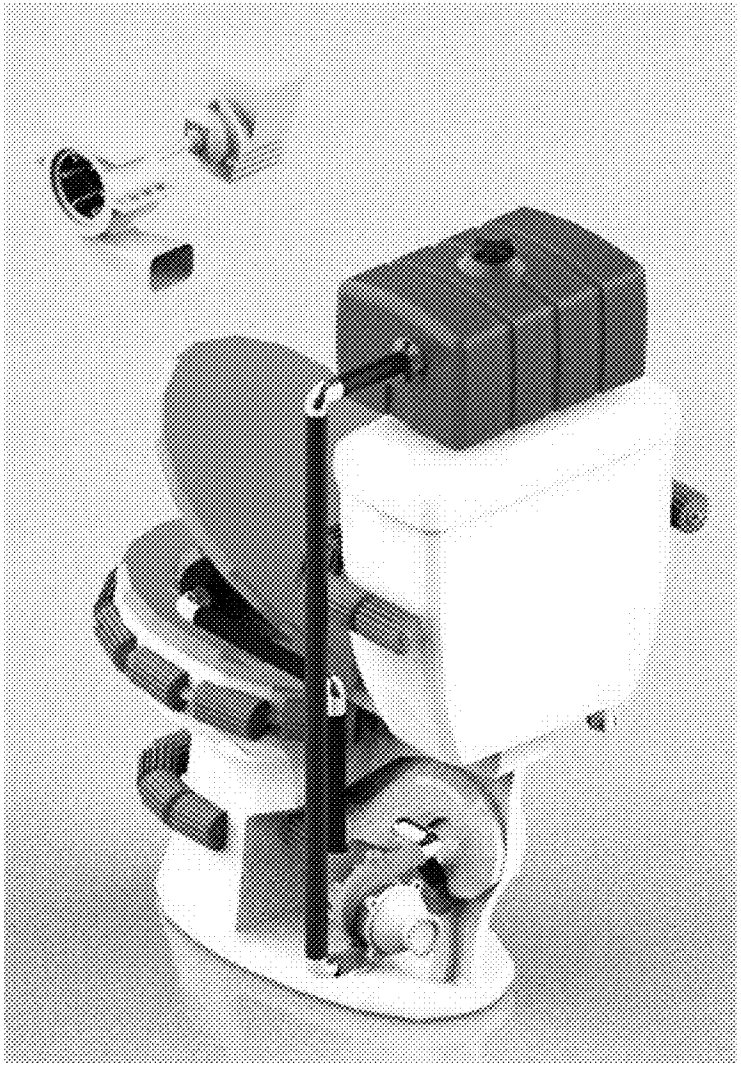
Figure 24:
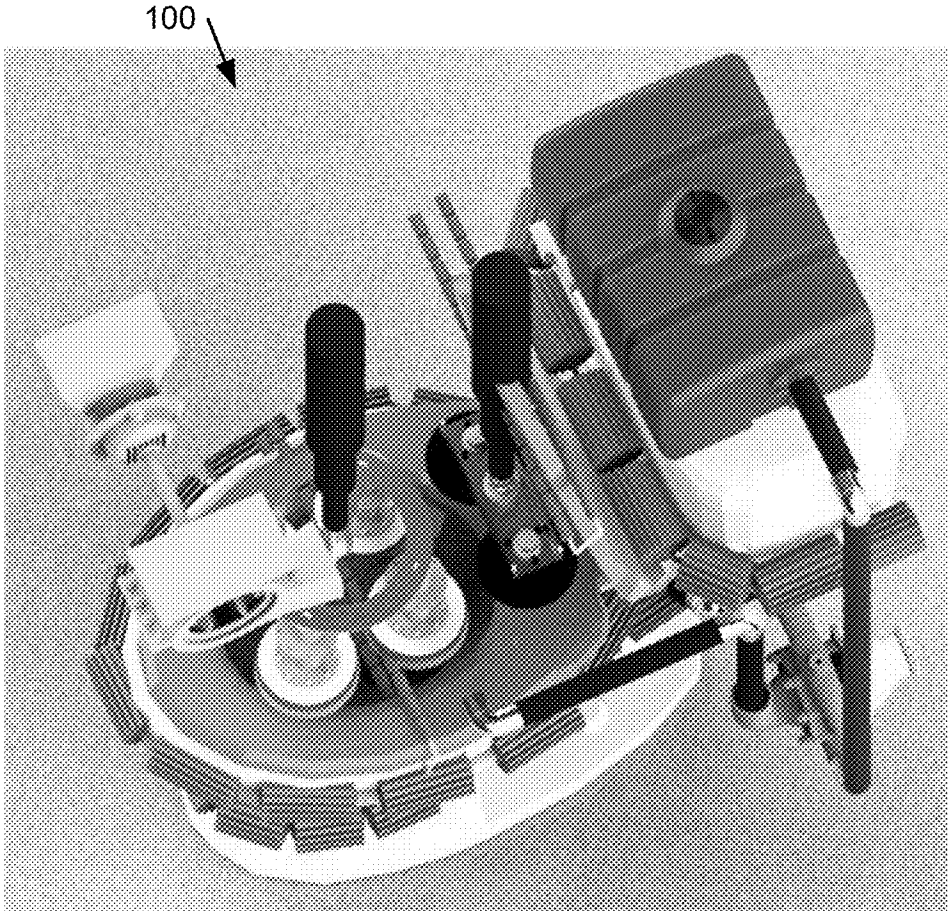
Figure 32:
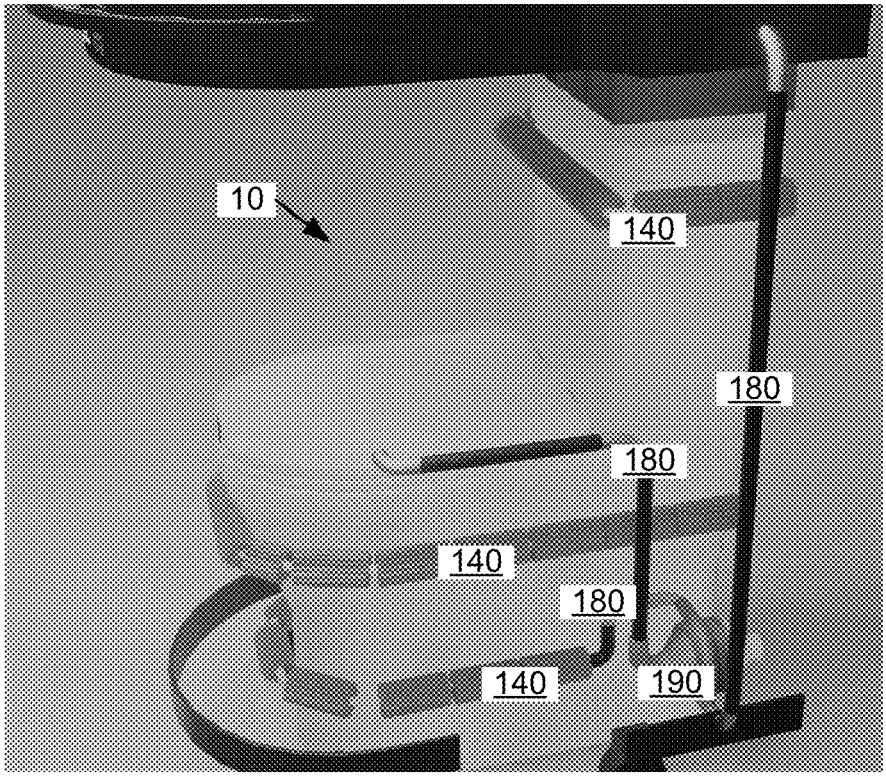
Figure 33:
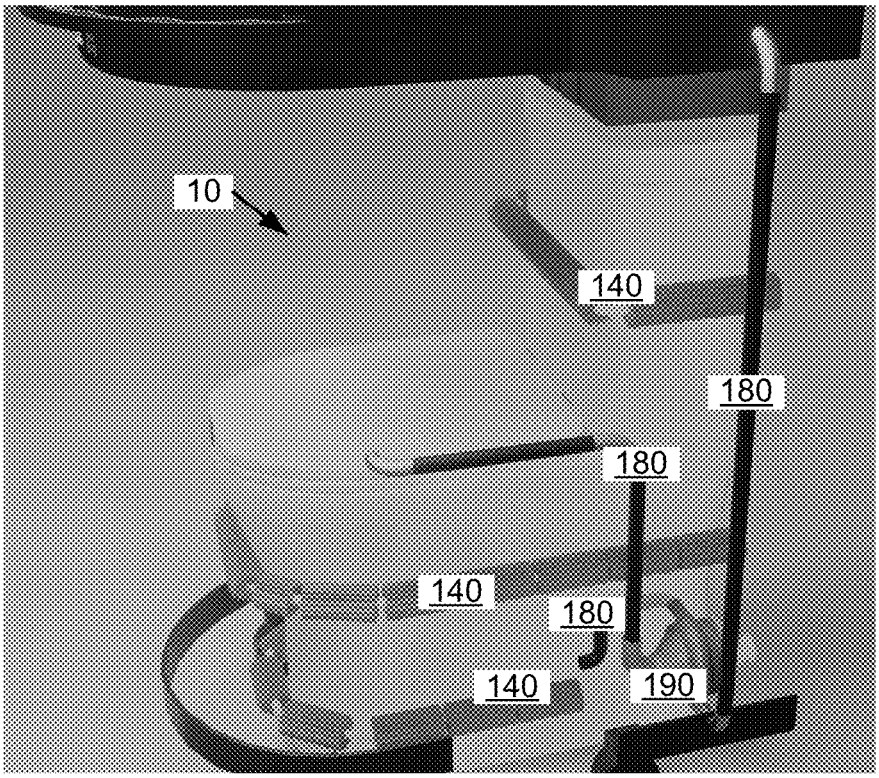
Figure 34:
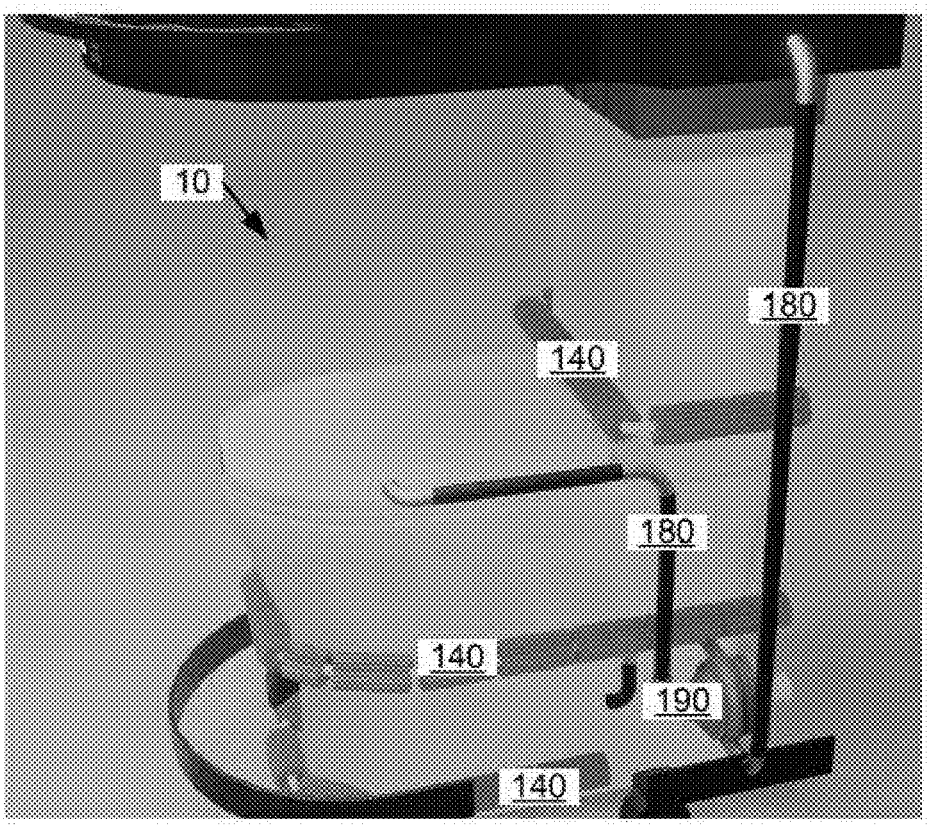

As shown in FIGS. 1 and 12, in some implementations, the self-cleaning toilet cleaner 100 comprises a housing 110. As shown in FIGS. 5 and 19, in some implementations, the self-cleaning toilet cleaner 100 may comprise one or more reservoirs 120. As shown in FIGS. 7 and 35-37, in some implementations, the self-cleaning toilet cleaner 100 may comprise a toilet opener 130. As shown in FIGS. 32-34, in some implementations, the self-cleaning toilet cleaner 100 may comprise one or more exterior brushes 140. As shown in FIGS. 7 and 41-43, in some implementations, the self-cleaning toilet cleaner 100 may comprise one or more bowl brushes 150.

Figure 2:
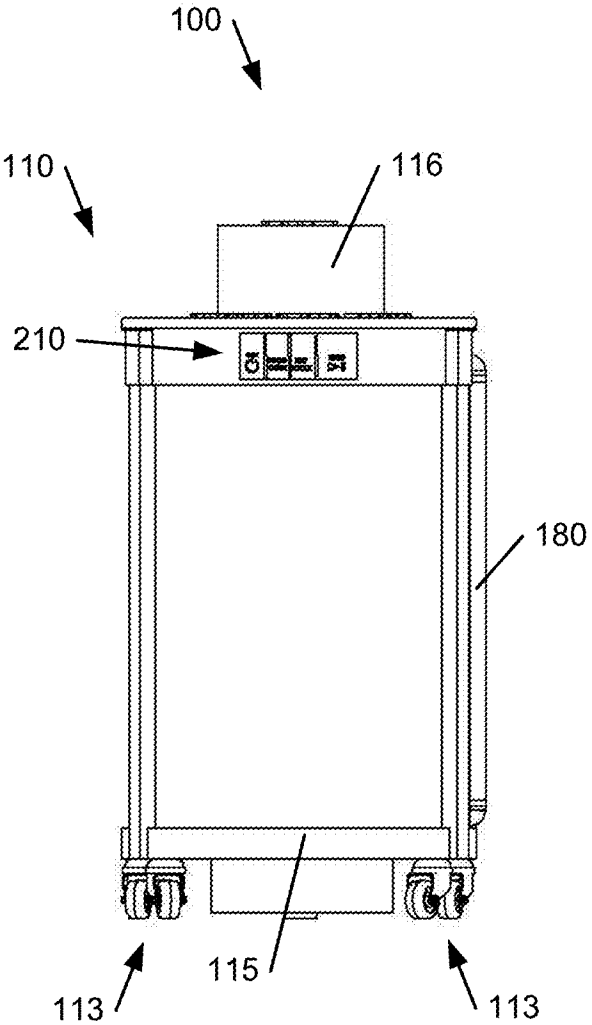
Figure 18:
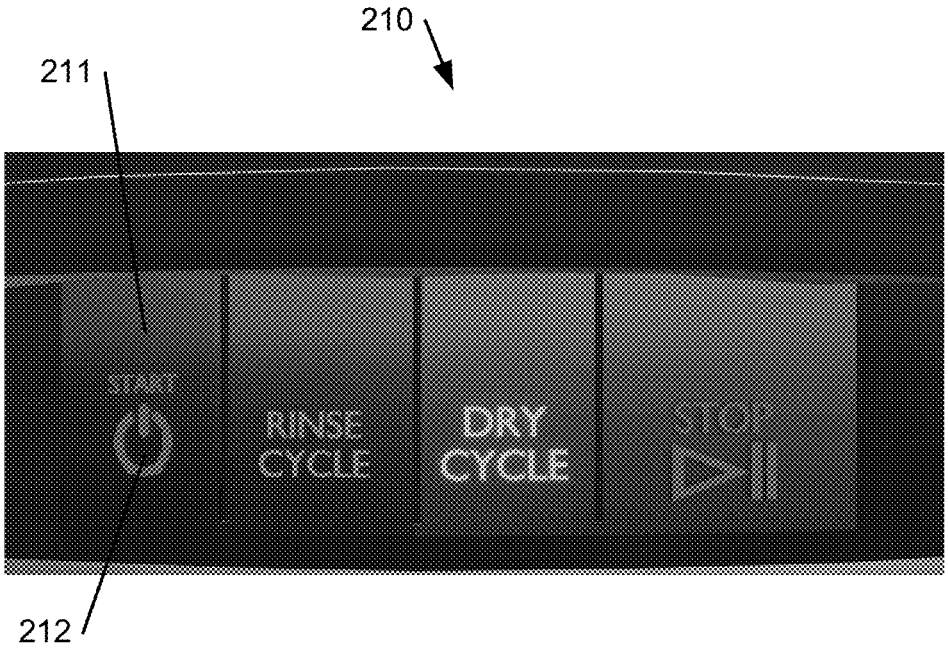
Figure 38:
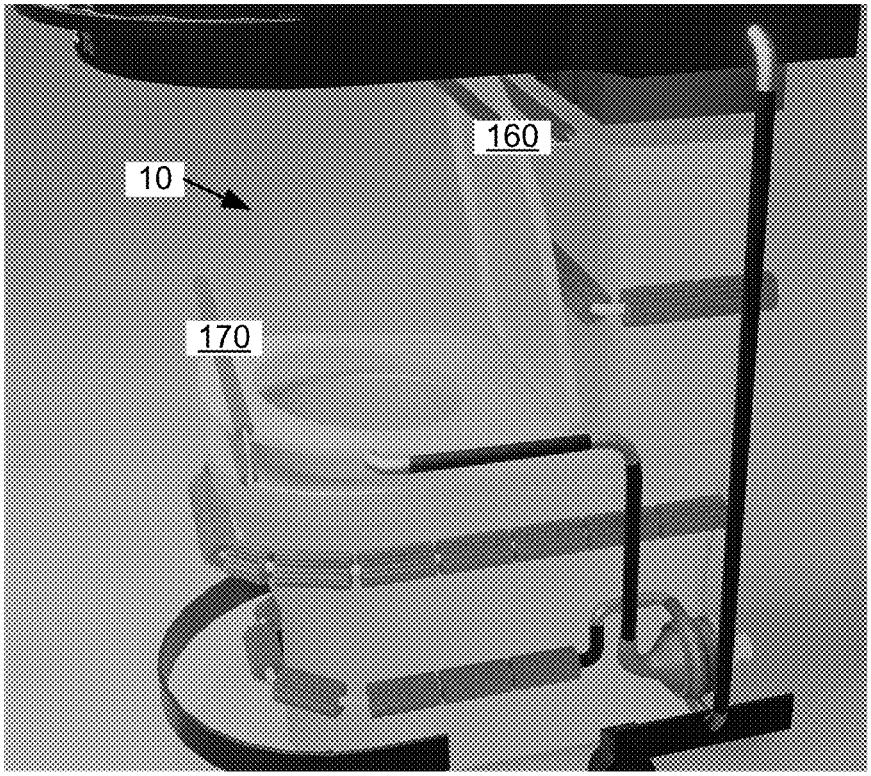
Figure 39:
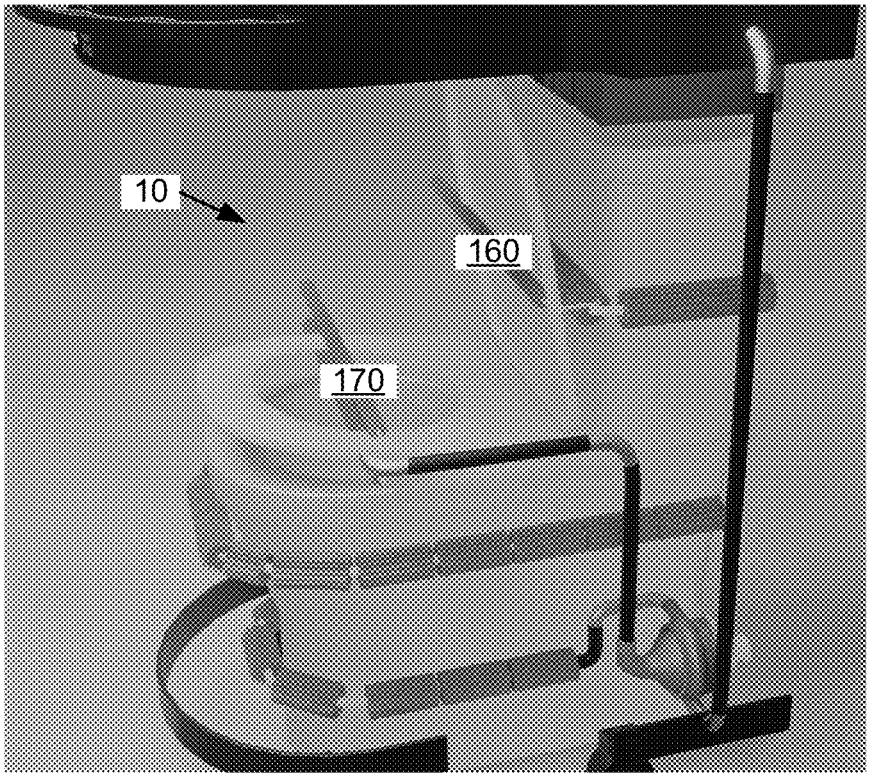
Figure 40:
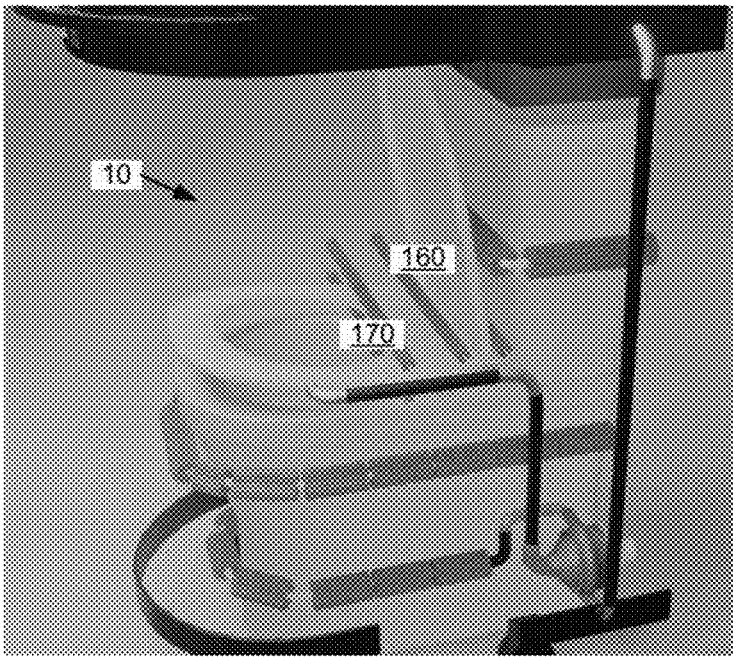
Figure 41:
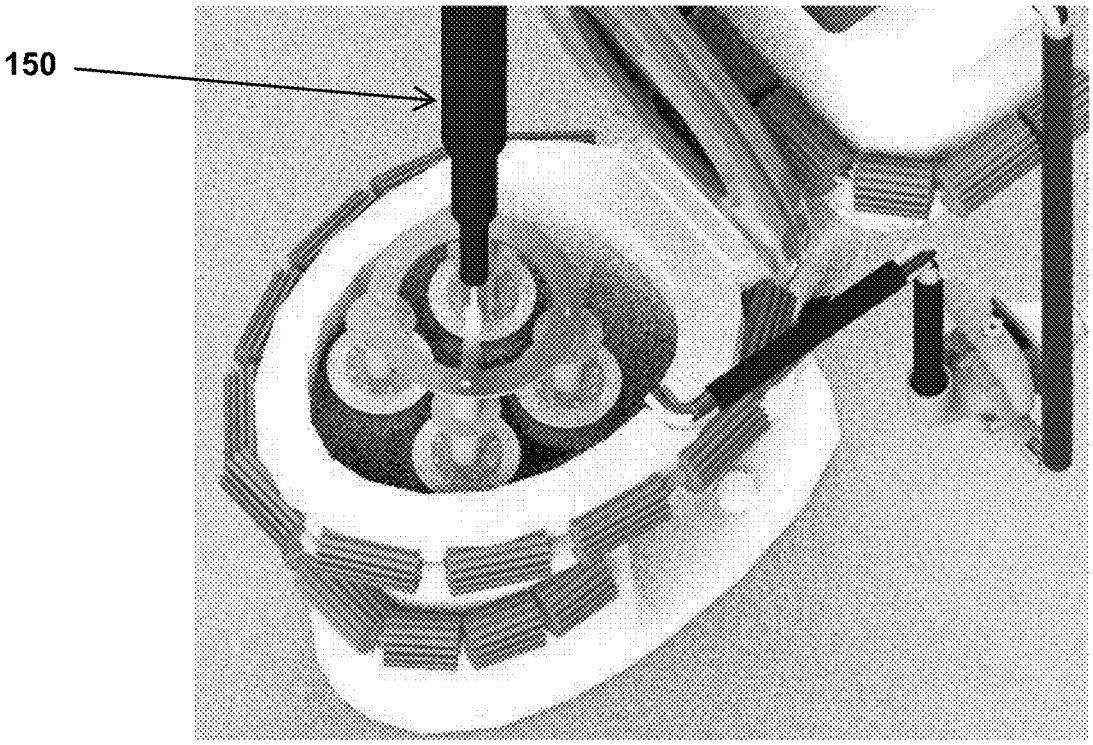
Figure 42:
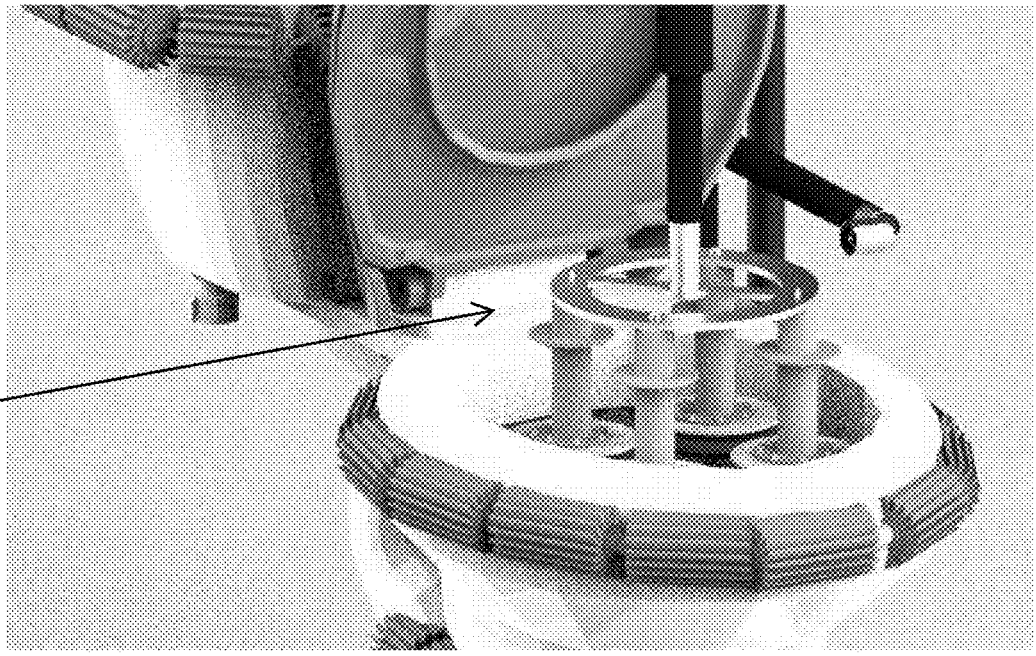
Figure 43:
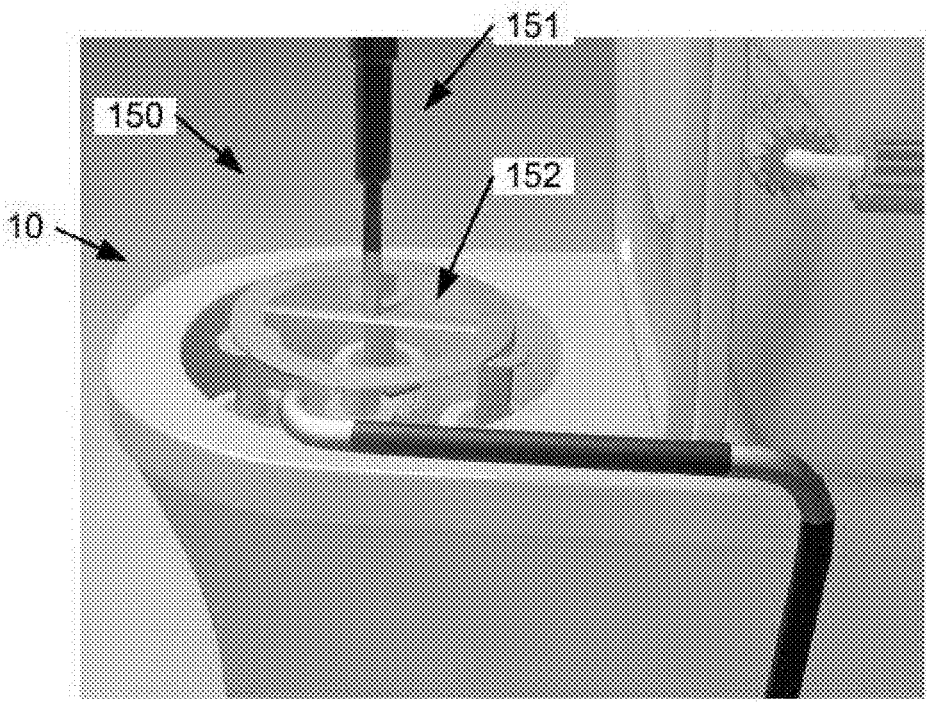
Figure 44:
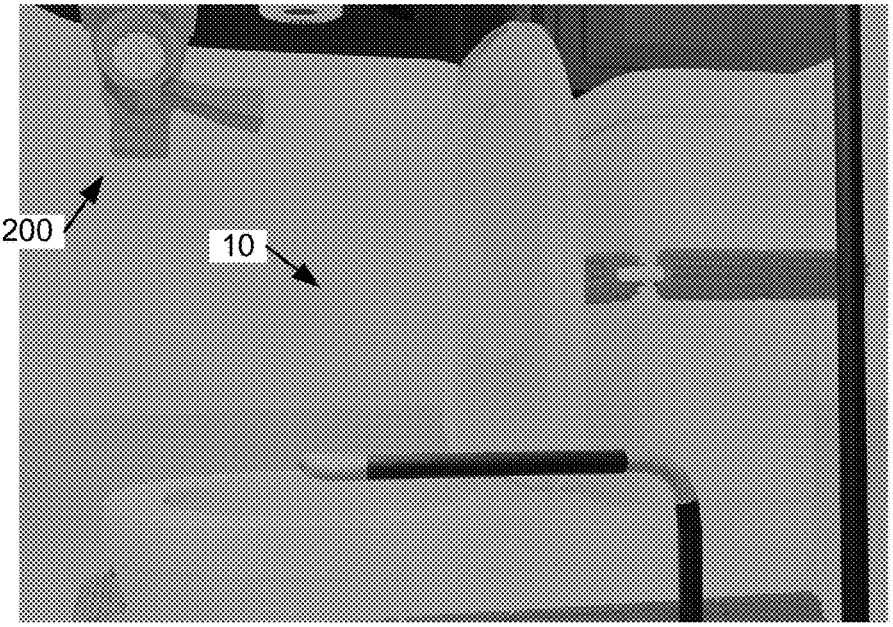

As shown in FIGS. 38-40, in some implementations, the self-cleaning toilet cleaner 100 may comprise one or more lid brushes 160 and/or one or more seat brushes 170. As shown in FIG. 32, in some implementations, the self-cleaning toilet cleaner 100 may comprise one or more fluid lines 180 and/or one or more fluid pumps 190. As shown in FIGS. 5 and 44, in some implementations, the self-cleaning toilet cleaner 100 may comprise one or more blowers 200. As shown in FIGS. 2 and 18, in some implementations, the self-cleaning toilet cleaner 100 may comprise one or more operation pads 210.

In some implementations, the self-cleaning toilet cleaner 100 may further comprise one or more operation motors. In some implementations, the self-cleaning toilet cleaner 100 may further comprise one or more sensors. In some implementations, the self-cleaning toilet cleaner 100 may further comprise a computer system.

Figure 4:
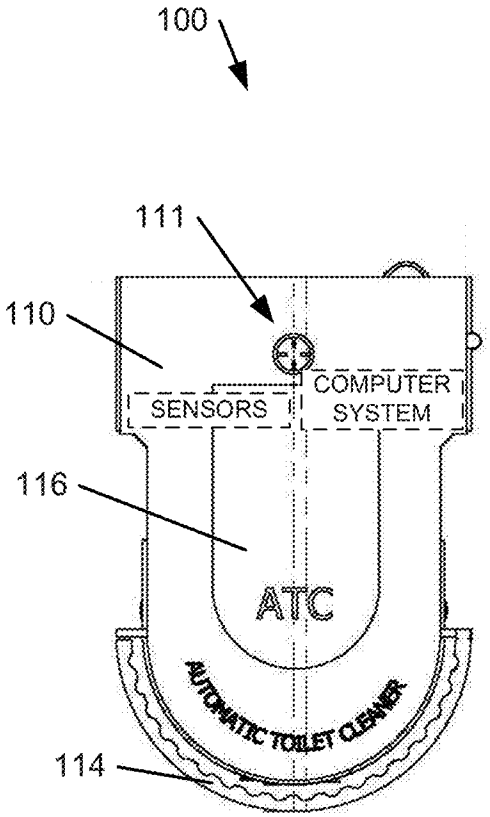
Figure 16:
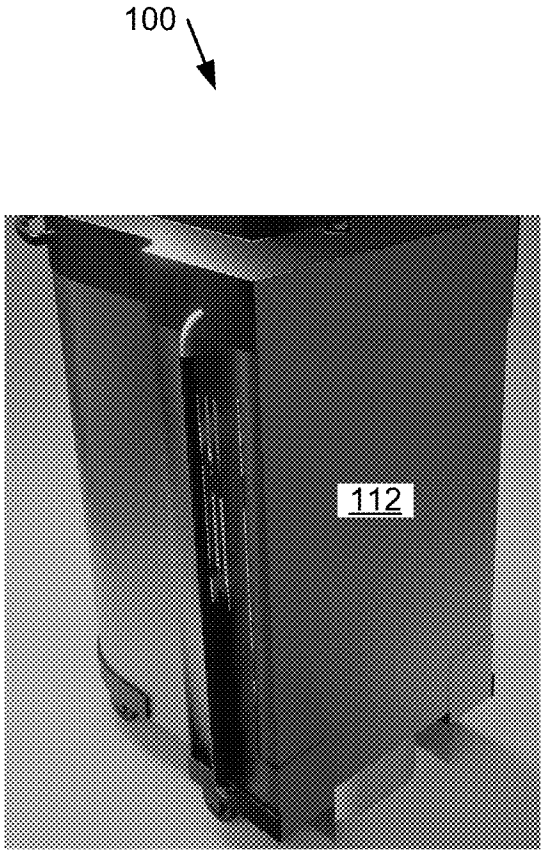

As shown in FIGS. 4 and 5, in some implementations, the housing 110 may comprise one or more fluid openings 111. As shown in FIG. 16, in some implementations, the housing 110 may comprise a door 112. As shown in FIG. 1, in some implementations, the housing 110 may comprise one or more wheels 113, handles 114, and/or bumpers 115. As shown in FIG. 1, in some implementations, the housing 110 may also comprise a dome portion 116.

As shown in FIGS. 1-4, in some implementations, the housing 110 may be generally rectangular prism shaped. In some implementations, the housing 100 may be any other suitable shape and size that allows the self-cleaning toilet cleaner 100 to at least partly enclose a toilet. For example, as shown in FIG. 19, in some implementations, the sides of the housing 110 may be similar in shape to the side perimeter of a toilet.

As shown in FIG. 5, in some implementations, the fluid opening 111 may be connected to the reservoir 120, which is described below. In some implementations, the fluid opening 111 may be any suitable size. In some implementations, the fluid opening 111 may be any suitable shape.

In some implementations, the fluid opening 111 may be at any suitable position on the housing 110.

In some implementations, the fluid opening 111 may be configured to allow fluid to be added to the reservoir 120. In some implementations, the fluid opening 111 may be configured to allow fluid to be removed from the reservoir 120.

As shown in FIG. 16, in some implementations, the door 112 may be generally rectangular shaped. In some implementations, the door 112 may be any other suitable shape.

In some implementations, the door 112 may generally extend the height and width of the housing 110. In some implementations, the door 112 may be any other suitable size.

As shown in FIG. 16, in some implementations, the door 112 may be positioned on the back or rear-facing side of the housing 110. In some implementations, the door 112 may be at any other suitable position on the housing 110.

Figure 29:
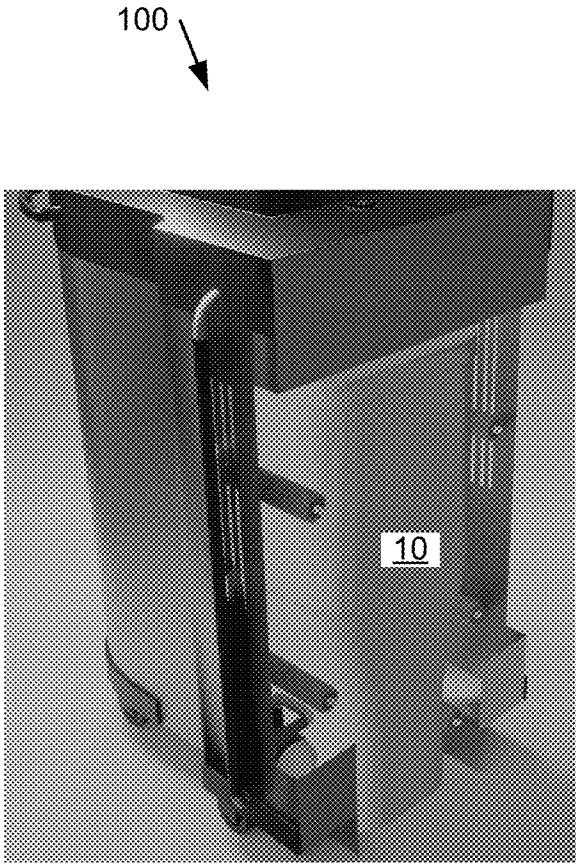
Figure 31:
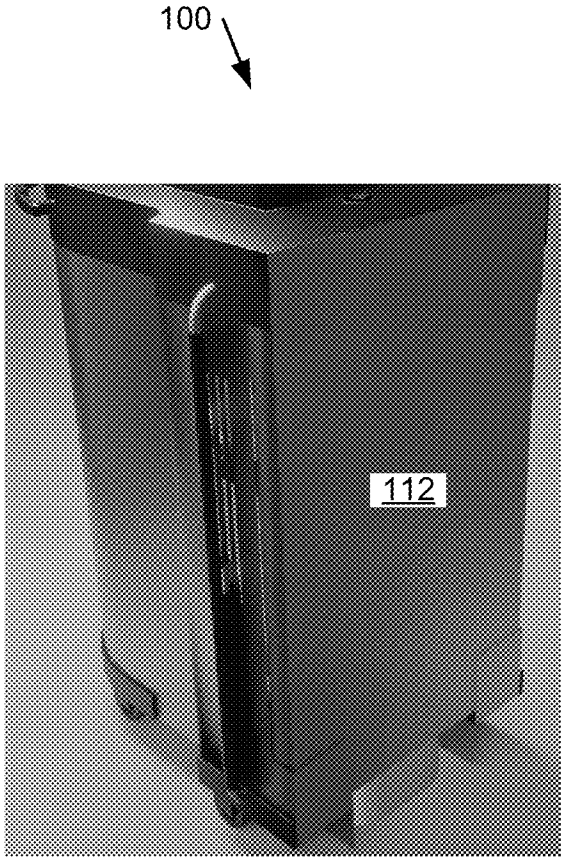
Figure 30:
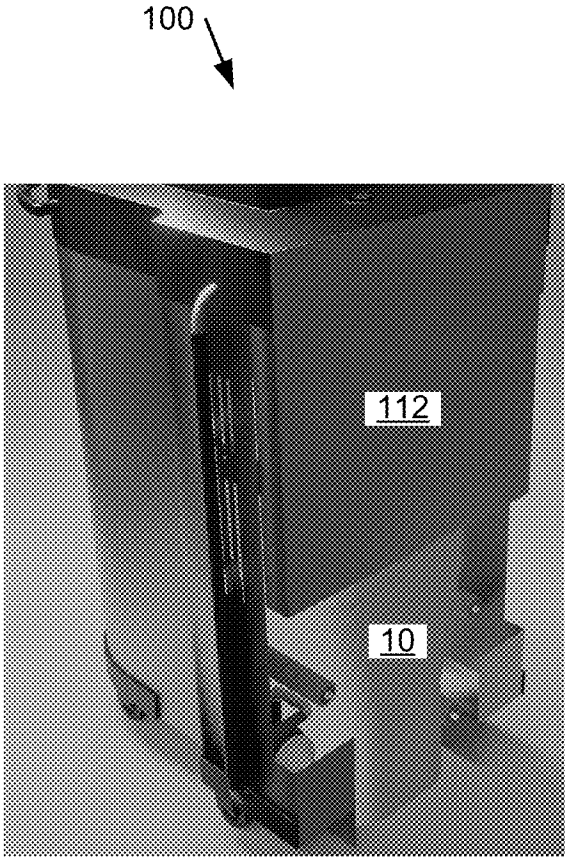

As shown in FIGS. 29-31, in some implementations, the door 112 may be configured to open and close. For example, in some implementations, the door 112 may be configured to retractably open and close. In some implementations, the door 112 may be configured to open and close in any other suitable way.

Figure 47:
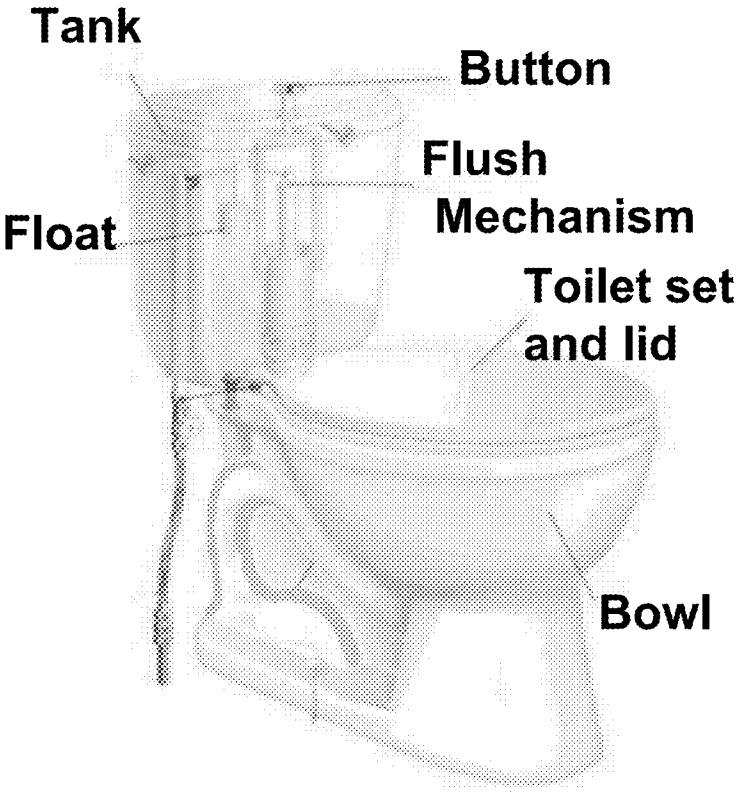
FIG. 47 (PRIOR ART)
FIG. 47 illustrates a typical existing toilet.

As shown in FIGS. 29-31, in some implementations, the door 112 may be configured to close such that the housing 110 encapsulates or encloses a toilet 10. For example, FIG. 47 illustrates a typical existing toilet 10.

Figure 28:
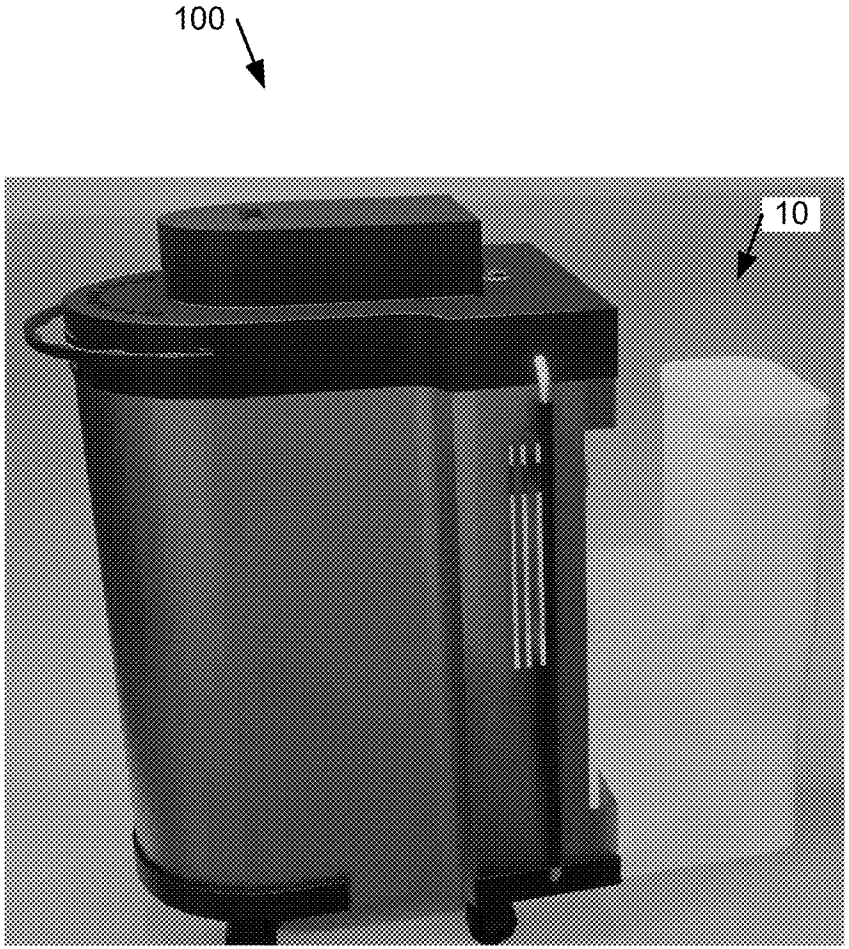
Figure 45:
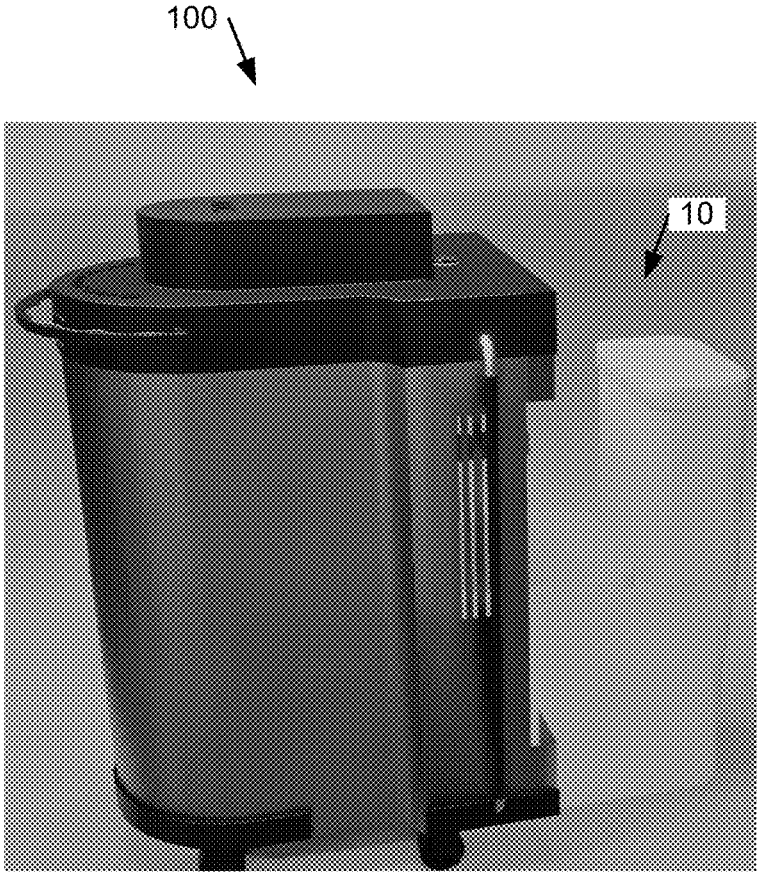

As shown in FIGS. 28 and 45, in some implementations, the door 112 may be configured to open such that the housing 110 can be moved or removed from around a toilet 10.

In some implementations, the wheels 113 may be any suitable type of wheels. In some implementations, the wheels 113 may be any suitable size. In some implementations, the wheels 113 may be any suitable shape.

In some implementations, the wheels 113 may be any other suitable configuration of wheels.

Figure 3:
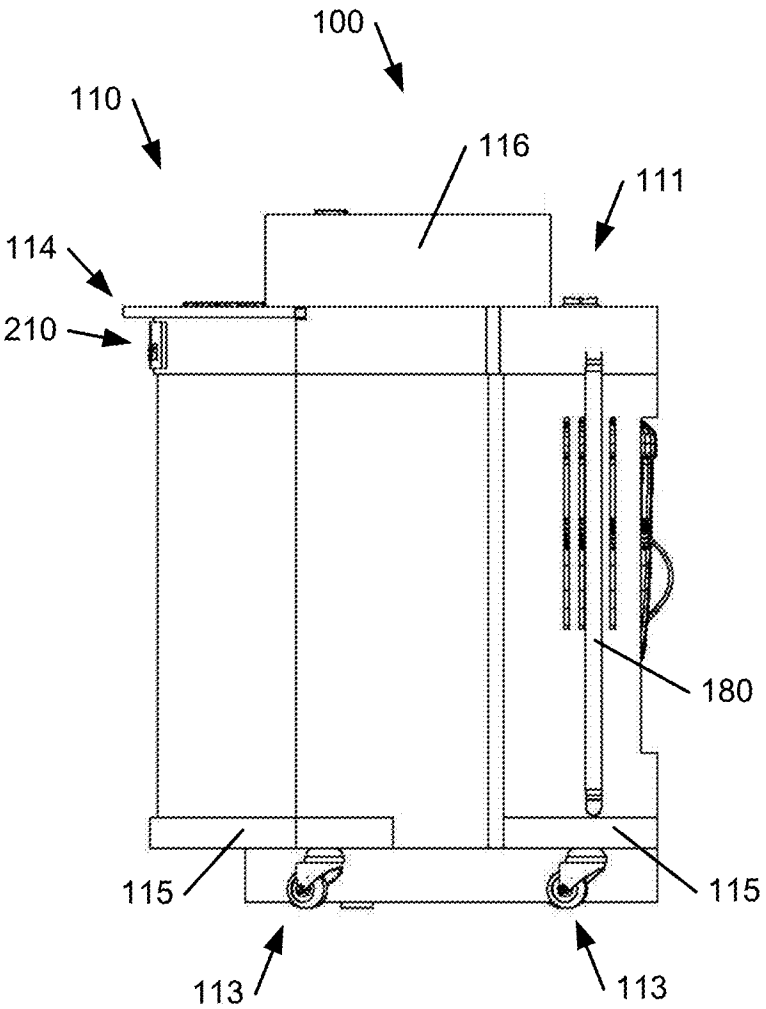

As shown in FIGS. 1-3, in some implementations, the wheels 113 may be positioned on the bottom or downward facing side of the housing 110. In some implementations, the wheels 113 may be at any other suitable position on the housing 110.

As shown in FIGS. 27-29, 45, and 46, in some implementations, the wheels 113 may be configured to allow the self-cleaning toilet cleaner 100 to moved or removed across a floor or other surface from around a toilet 10. In some implementations, the wheels 113 may be configured to allow any other suitable use of the self-cleaning toilet cleaner 100.

In some implementations, the handle 114 may be any suitable type of handle. In some implementations, the handle 114 may be any suitable size. In some implementations, the handle 114 may be any suitable shape.

In some implementations, the handle 114 may be any other suitable configuration of handle.

As shown in FIGS. 1 and 4, in some implementations, the handle 114 may be positioned on the front or forward facing side of the housing 110. In some implementations, the handle 114 may be positioned adjacent to the top or upward facing side of the housing 110.

In some implementations, the handle 114 may be at any other suitable position on the housing 110.

In some implementations, the handle 114 may be configured to allow the self-cleaning toilet cleaner 100 to moved or removed from around a toilet 10. For example, in some implementations, the handle 114 may be configured to allow the self-cleaning toilet cleaner 100 to be pushed across a floor or other surface on the wheels 113.

In some implementations, the handle 114 may be configured to allow any other suitable use of the self-cleaning toilet cleaner 100.

In some implementations, the bumpers 115 may be any other suitable size. In some implementations, the bumpers 115 may be any other suitable shape. For example, as shown in FIGS. 1-3, in some implementations, the bumpers 115 may be sized and shaped to extend at least partly around one or more the sides of the housing 110.

As shown in FIGS. 1-3, in some implementations, the bumpers 115 may be positioned on the front and sides of the housing 110. In some implementations, the bumpers 115 may be positioned adjacent to the bottom or downward facing side of the housing 110.

In some implementations, the bumpers 115 may be at any other suitable position on the housing 110.

As shown in FIGS. 1-4, in some implementations, the dome portion 116 may be generally rectangular dome shaped. In some implementations, the dome portion 116 may be any other suitable shape and size.

As shown in FIGS. 5, 7, 25, and 26, in some implementations, the dome portion 116 may be configured at least partly receive therein one or more components of the self-cleaning toilet cleaner 100. For example, in some implementations, the dome portion 116 may be configured to at least partly receive therein the toilet opener 130 and the bowl brushes 150, such as in a retracted configuration.

In some implementations, the dome portion 116 may be configured to provide any other suitable feature of the housing 110.

Figure 7:
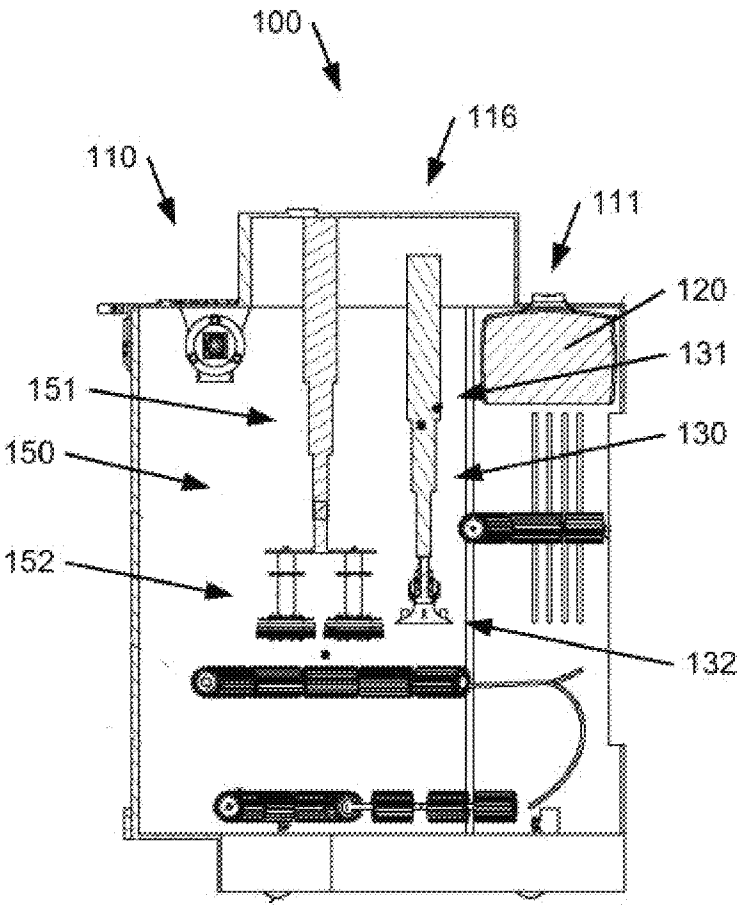
Figure 6:
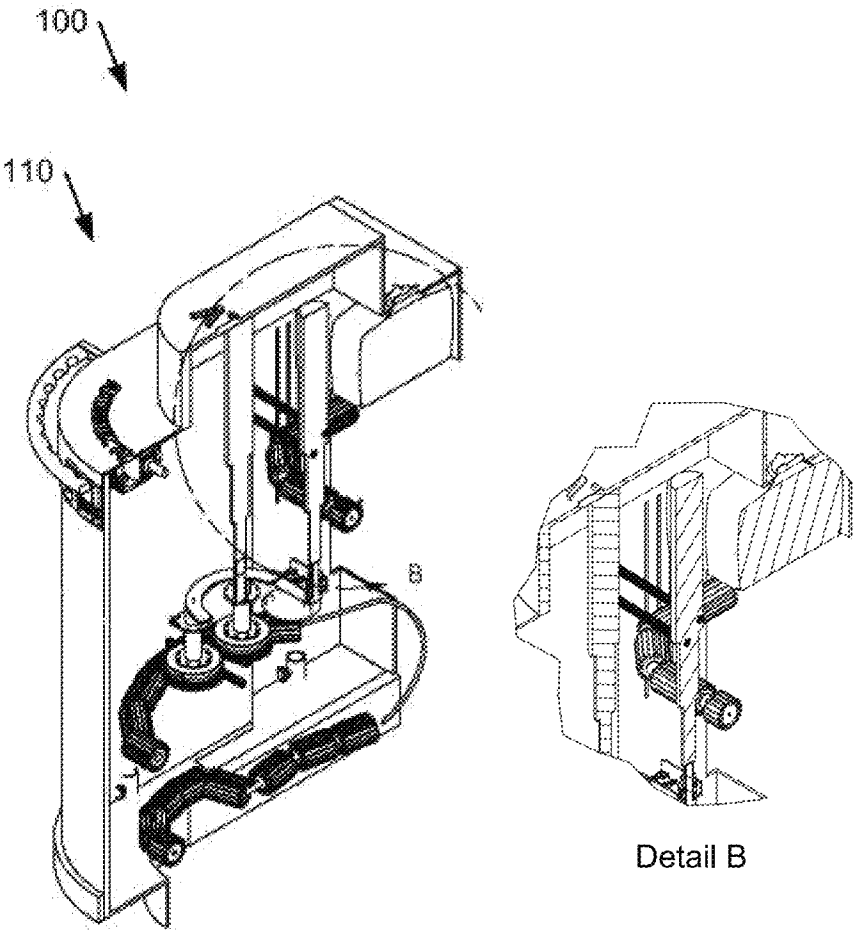
Figure 9:
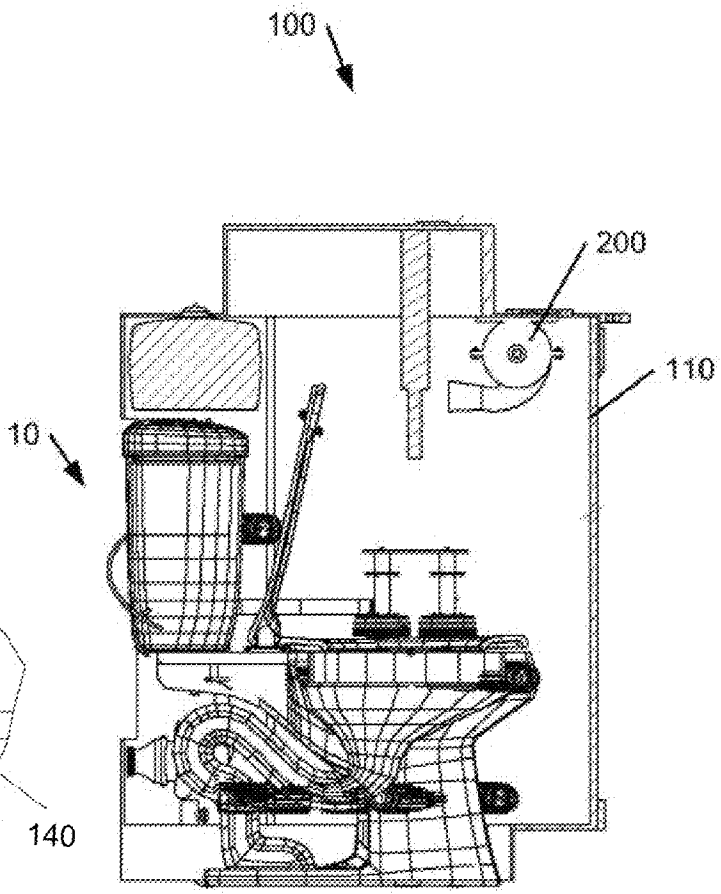
Figure 8:
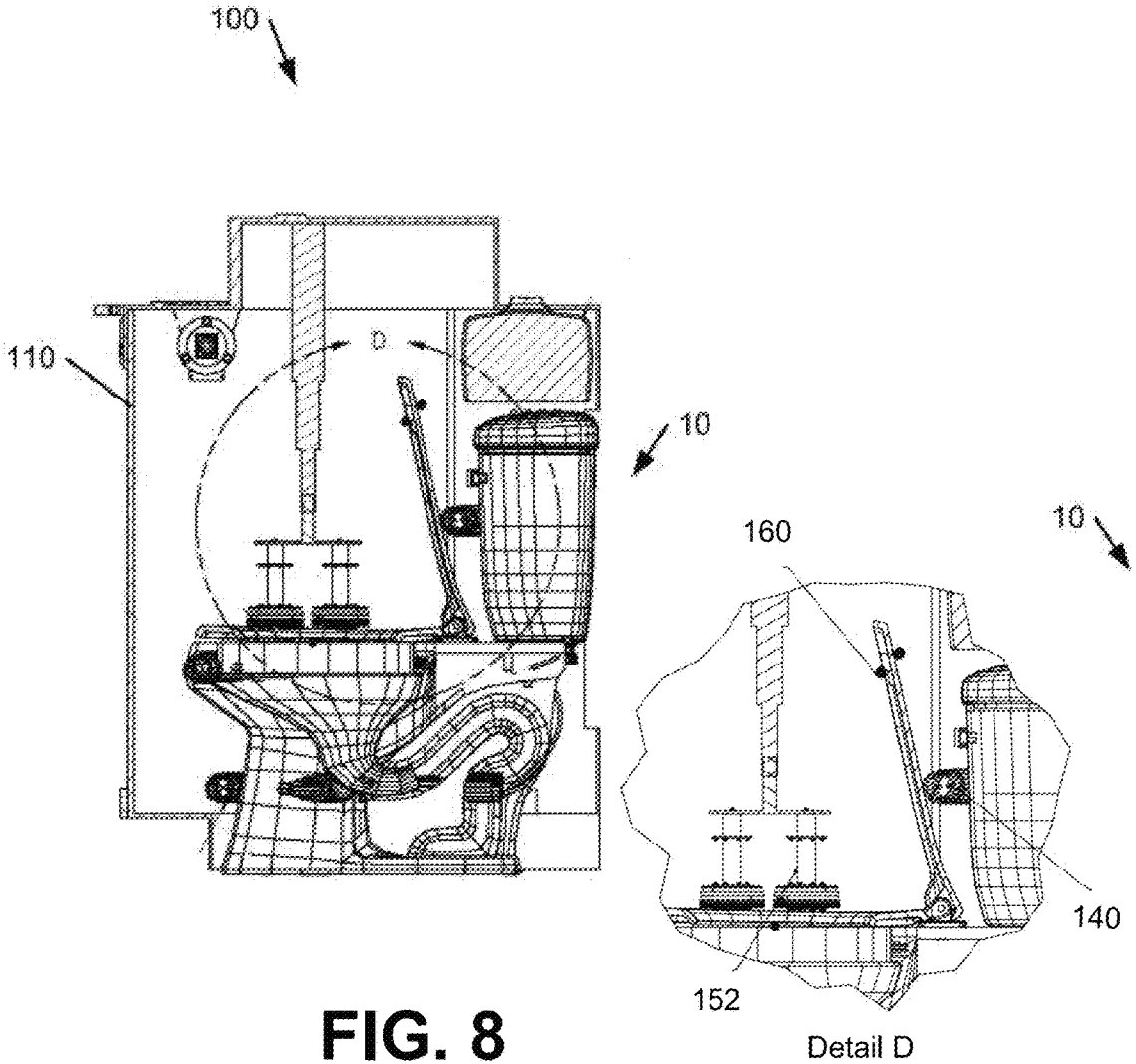
Figure 11:
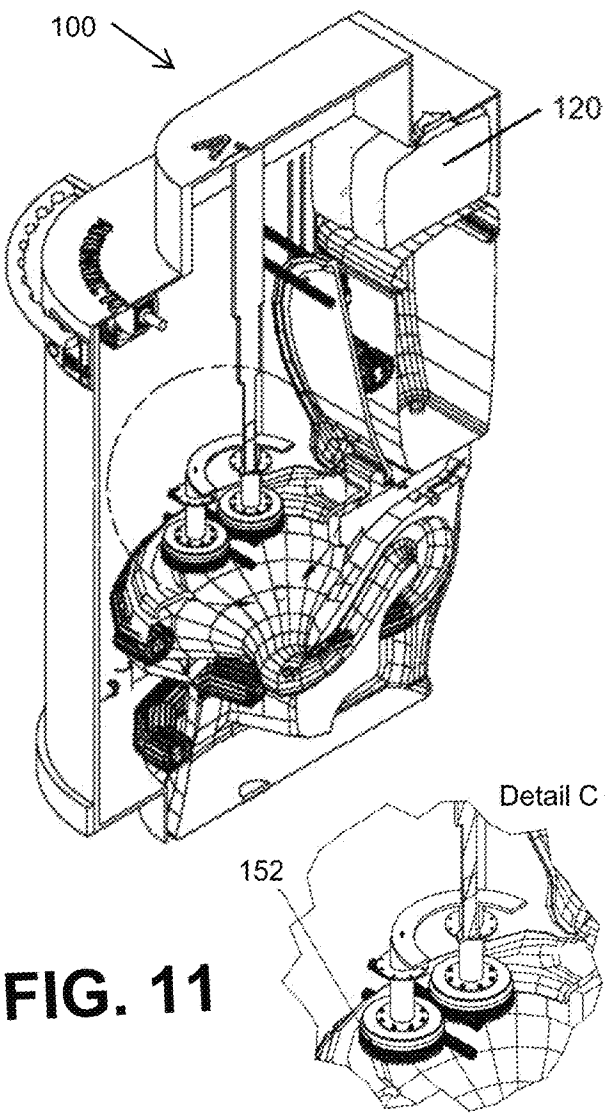
Figure 10:
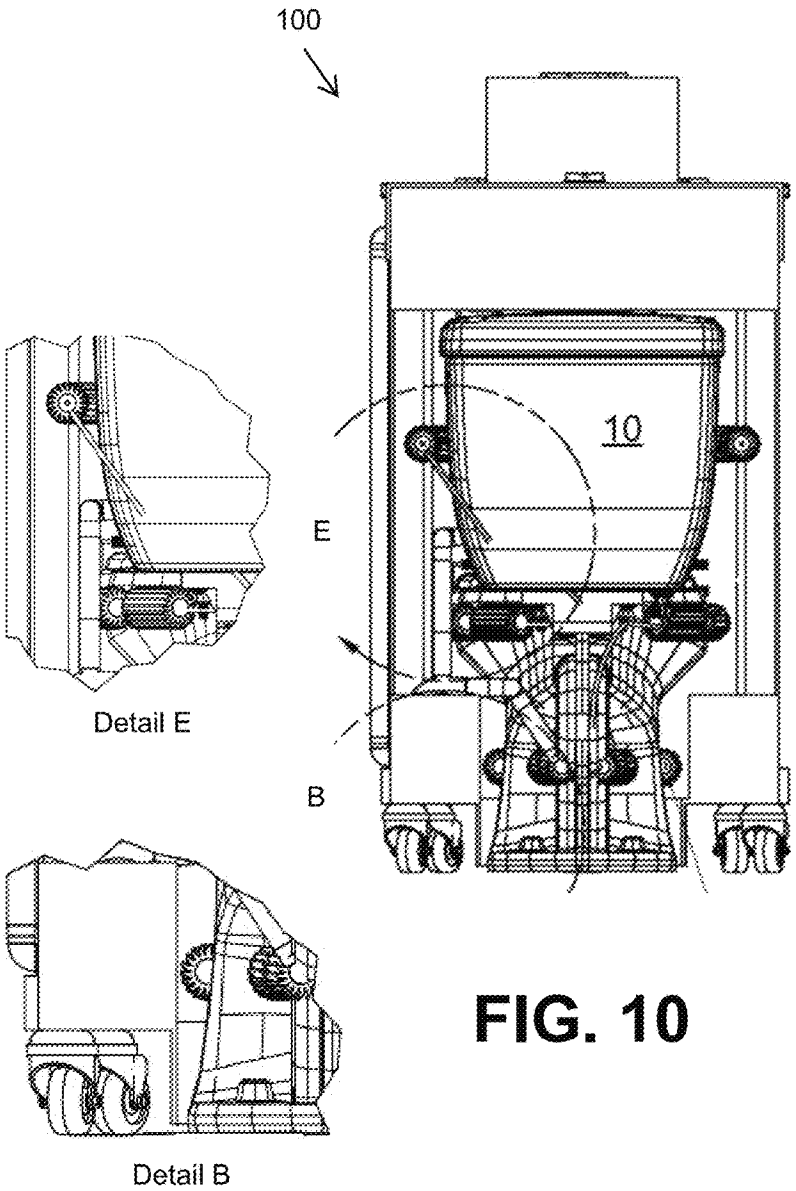
Figure 13:
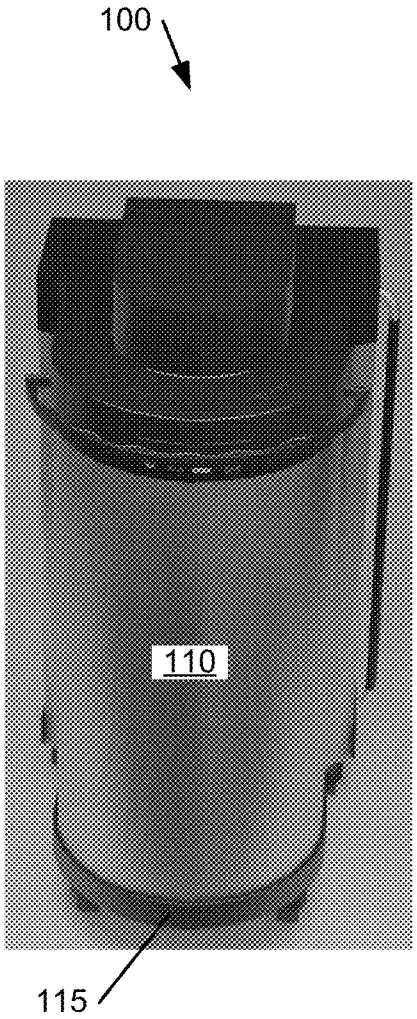

As shown in FIGS. 5-7, in some implementations, the housing 110 is configured to attach to and hold therein other components of the self-cleaning toilet cleaner 100.

As shown in FIGS. 5-7, in some implementations, the housing 110 is configured to at least partly encapsulate or enclose a toilet 10 so that the self-cleaning toilet cleaner 100 can self-clean the toilet 10. In some implementations, the housing 110 is configured to fully encapsulate or enclose a toilet 10 so that the self-cleaning toilet cleaner 100 can self-clean the toilet 10.

In some implementations, the housing 110 may be configured to encapsulate or enclose a toilet 10 in a water-tight seal to hold in fluids while the self-cleaning toilet cleaner 100 cleans the toilet 10.

In some implementations, the housing 110 may be configured to provide any other suitable features of the self-cleaning toilet cleaner 100.

As shown in FIGS. 5 and 19, in some implementations, the reservoir 120 comprises a tank or other suitable container for receiving and/or holding fluid(s) for operation of the self-cleaning toilet cleaner 100.

In some implementations, the reservoir 120 may be any suitable size. In some implementations, the reservoir 120 may be any suitable shape. For example, as shown in FIGS. 5 and 19, in some implementations, the reservoir 120 may be generally rectangular prism shaped.

In some implementations, the reservoir 120 may be in any suitable position of the housing 110. For example, as shown in FIGS. 5 and 19, in some implementations, the reservoir 120 may be positioned adjacent to the top side and the back side of the housing 110. In some implementations, the reservoir 120 is positioned in the housing 110 such that the reservoir positions over or adjacent to the toilet tank of a toilet 10 when the self-cleaning toilet cleaner 100 is positioned to clean the toilet 10.

In some implementations, the reservoir 120 is connected to the fluid opening 111 such that fluid can be added or removed from the reservoir 120 through the opening 111. In some implementations, the reservoir 120 is further connected to other components of the self-cleaning toilet cleaner 100 such as the fluid line 180 and/or the fluid pump 190 as described below.

In some implementations, the reservoir 120 may be configured to hold a cleaning solution for use by the self-cleaning toilet cleaner 100. In some implementations, the cleaning solution may comprise a soap, disinfectant, and/or other suitable contents for cleaning the toilet 10.

In some implementations, the reservoir 120 may be configured to hold clean water for use by the self-cleaning toilet cleaner 100. In some implementations, the reservoir 120 may be configured to hold dirty water from use of the self-cleaning toilet cleaner 100.

In some implementations, the reservoir 120 may be configured to hold any other suitable fluid(s).

In some implementations, the toilet opener 130 may comprise any suitable mechanism that can extend from the housing 110 and lift or lower the lid and/or seat of a toilet. For example, as shown in FIGS. 7 and 35-37, in some implementations, the toilet opener 130 may comprise a mechanism having an extension portion 131 and an attachment portion 132.

In some implementations, the toilet opener 130 may be any suitable size. In some implementations, the toilet opener 130 may be any suitable shape.

Figure 25:
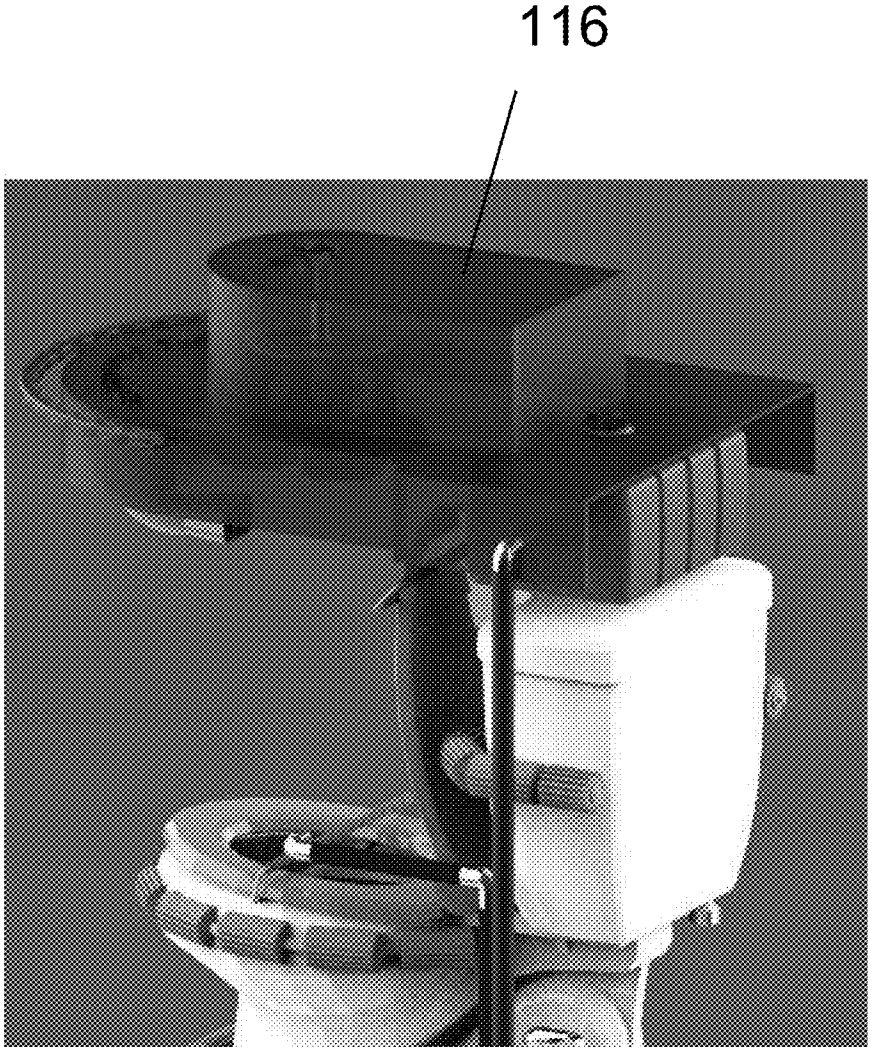
Figure 26:
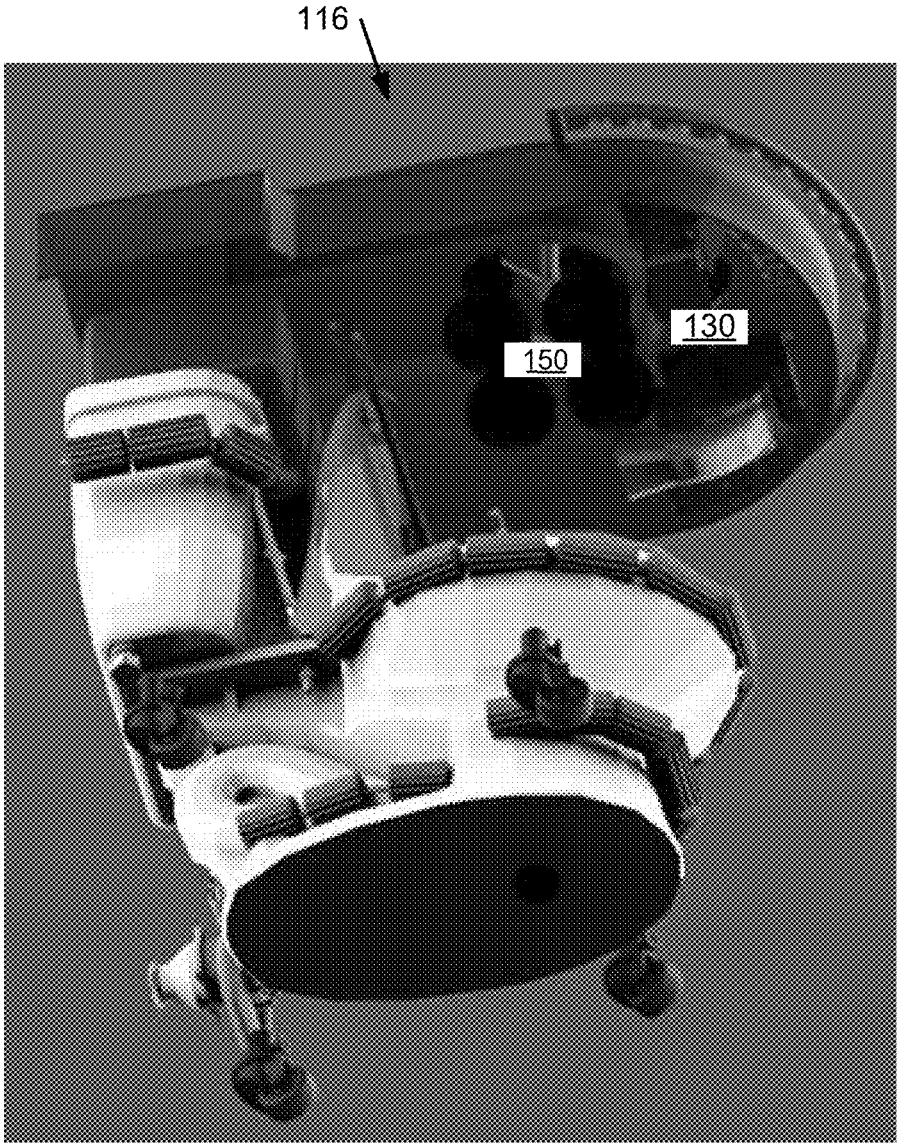

In some implementations, the toilet opener 130 may be at any suitable position on the housing 110. For example, as shown in FIGS. 7, 25, and 26, in some implementations, the toilet opener 130 may be positioned to extend from the dome portion 116 of the housing 110.

In some implementations, the extension portion 131 may comprise any suitable mechanism that can extend the attachment portion 132 from the housing 110 to the lid and/or seat of a toilet 10. For example, as shown in FIGS. 7 and 35-37, in some implementations, the extension portion 131 may comprise an elongated telescoping mechanism.

In some implementations, the attachment portion 132 may comprise any suitable mechanism that can engage the lid and/or seat of a toilet 10 to allow the toilet opener 130 to lift or lower the lid and/or seat of the toilet 10. For example, as shown in FIGS. 7 and 35-37, in some implementations, the attachment portion 132 may comprise a suction cup mechanism.

In some implementations, the toilet opener 130 is configured to extend from the housing 110 and lift or lower the lid and/or seat of a toilet. In some implementations, the toilet opener 130 may be configured to provide any other suitable feature of the self-cleaning toilet cleaner 100.

In some implementations, the exterior brushes 140 may comprise any suitable mechanism that can extend from the housing 110 and apply one or more brushes to clean the exterior or outer surface of a toilet. For example, as shown in FIGS. 32-34, in some implementations, the exterior brushes 140 may comprise one or more generally cylindrical shaped brushes extending around the front and side exterior surfaces of a toilet 10.

In some implementations, the exterior brushes 140 may extend around the exterior surface of the upper or tank portion of the toilet 10. In some implementations, the exterior brushes 140 may extend around the exterior surface of the lower or bowl portion of the toilet 10.

In some implementations, the exterior brushes 140 may extend around the exterior surface of any other suitable portion of the toilet 10.

As shown in FIGS. 32-34, in some implementations, the exterior brushes 140 may be configured to move in a downward and/or upward motion along the exterior surface of the toilet 10. In some implementations, the exterior brushes 140 may be configured to move in any other suitable direction along the exterior surface of the toilet 10.

In some implementations, the exterior brushes 140 may be configured to rotate upon the exterior surface of the toilet 10.

In some implementations, the exterior brushes 140 are configured to clean the exterior surface of a toilet 10. In some implementations, the exterior brushes 140 may be configured to clean the exterior surface of a toilet 10 by moving along and/or rotating upon the surface.

In some implementations, the exterior brushes 140 may be configured to clean the exterior surface of a toilet 10 by scrubbing a fluid applied to the surface by the self-cleaning toilet cleaner 100. For example, in some implementations, the lid brushes 160 may be further configured to apply the fluid to the exterior.

In some implementations, the exterior brushes 140 may be configured to clean the exterior surface of a toilet 10 in any other suitable way.

In some implementations, the bowl brushes 150 may comprise any suitable mechanism that can extend from the housing 110 and apply one or more brushes to clean the bowl of a toilet. For example, as shown in FIGS. 7 and 41-43, in some implementations, the bowl brushes 150 may comprise a mechanism having an extension portion 151 and a brush portion 152.

In some implementations, the bowl brushes 150 may be at any suitable position on the housing 110. For example, as shown in FIGS. 7, 25, and 26, in some implementations, the bowl brushes 150 may be positioned to extend from the dome portion 116 of the housing 110.

In some implementations, the extension portion 151 may comprise any suitable mechanism that can extend the brush portion 152 from the housing 110 into the bowl of a toilet 10. For example, as shown in FIGS. 7 and 41-43, in some implementations, the extension portion 151 may comprise an elongated telescoping mechanism.

In some implementations, the brush portion 152 may comprise any suitable mechanism that can apply one or more brushes to clean the bowl of a toilet. For example, as shown in FIGS. 7 and 41-43, in some implementations, the bowl brushes 150 may comprise one or more generally circular or disc shaped brushes that can clean the bowl of a toilet 10.

In some implementations, the bowl brushes 150 may be configured to position such that the bowl brushes 150 can clean the surfaces extending from the exterior of a toilet 10 into the bowl of the toilet 10. In some implementations, the bowl brushes 150 may be configured to position in any other suitable way.

In some implementations, the bowl brushes 150 may be configured to rotate within the bowl of a toilet 10. In some implementations, the bowl brushes 150 may be configured to move in any other suitable way within the bowl of the toilet 10.

In some implementations, the bowl brushes 150 are configured to clean the bowl of a toilet 10. In some implementations, the bowl brushes 150 may be configured to clean the bowl of a toilet 10 by moving along and/or rotating upon the bowl.

In some implementations, the bowl brushes 150 may be configured to clean the bowl of a toilet 10 by scrubbing a fluid applied to the bowl by the self-cleaning toilet cleaner 100. For example, in some implementations, the bowl brushes 150 may be further configured to apply the fluid to the bowl.

In some implementations, the bowl brushes 150 may be configured to clean the bowl of a toilet 10 in any other suitable way.

In some implementations, the lid brushes 160 may comprise any suitable mechanism that can extend from the housing 110 and apply one or more brushes to clean the lid of a toilet. For example, as shown in FIGS. 38-40, in some implementations, the lid brushes 160 may comprise one or more generally cylindrical shaped brushes extending around the lid of a toilet 10.

As shown in FIGS. 38-40, in some implementations, the lid brushes 160 may be configured to move in a downward and/or upward motion along the lid of the toilet 10. In some implementations, the lid brushes 160 may be configured to move in any other suitable direction along the lid of the toilet 10.

In some implementations, the lid brushes 160 may be configured to rotate upon the lid of the toilet 10.

In some implementations, the lid brushes 160 are configured to clean the lid of a toilet 10. In some implementations, the lid brushes 160 may be configured to clean the lid of a toilet 10 by moving along and/or rotating upon the lid.

In some implementations, the lid brushes 160 may be configured to clean the lid of a toilet 10 by scrubbing a fluid applied to the lid by the self-cleaning toilet cleaner 100. For example, in some implementations, the lid brushes 160 may be further configured to apply the fluid to the lid.

In some implementations, the lid brushes 160 may be configured to clean the lid of a toilet 10 in any other suitable way.

In some implementations, the seat brushes 170 may comprise any suitable mechanism that can extend from the housing 110 and apply one or more brushes to clean the seat of a toilet. For example, as shown in FIGS. 38-40, in some implementations, the seat brushes 170 may comprise one or more generally cylindrical shaped brushes extending around the seat of a toilet 10.

As shown in FIGS. 38-40, in some implementations, the seat brushes 170 may be configured to move in a downward and/or upward motion along the seat of the toilet 10. In some implementations, the seat brushes 170 may be configured to move in any other suitable direction along the seat of the toilet 10.

In some implementations, the seat brushes 170 may be configured to rotate upon the seat of the toilet 10.

In some implementations, the seat brushes 170 are configured to clean the seat of a toilet 10. In some implementations, the seat brushes 170 may be configured to clean the seat of a toilet 10 by moving along and/or rotating upon the seat.

In some implementations, the seat brushes 170 may be configured to clean the seat of a toilet 10 by scrubbing a fluid applied to the seat by the self-cleaning toilet cleaner 100. For example, in some implementations, the seat brushes 170 may be further configured to apply the fluid to the seat.

In some implementations, the seat brushes 170 may be configured to clean the seat of a toilet 10 in any other suitable way.

In some implementations, the one or more fluid lines 180 may comprise any suitable components that can convey fluid between suitable components of the self-cleaning toilet cleaner 100. For example, as shown in FIG. 32, in some implementations, the fluid lines 180 may comprise pipes, tubing, and/or any other suitable components.

In some implementations, the fluid lines 180 may be any suitable size. In some implementations, the fluid lines 180 may be any suitable shape.

In some implementations, the fluid lines 180 may be at any suitable position on the housing 110. For example, as shown in FIG. 32, in some implementations, the fluid lines 180 may be positioned to extend between the reservoir 120, the fluid pumps 190, the exterior brushes 140, the bowl brushes 150, the lid brushes 160, the seat brushes 170, and/or the bowl of a toilet 10. In some implementations, the fluid lines 180 may be positioned to extend between any other suitable components of the self-cleaning toilet cleaner 100.

In some implementations, the fluid lines 180 are configured to convey fluid between any suitable components of the self-cleaning toilet cleaner 100. In some implementations, the fluid lines 180 may be configured to provide any other suitable features of the self-cleaning toilet cleaner 100.

In some implementations, the one or more fluid pumps 190 may comprise any suitable components that can pump and/or vacuum fluid between suitable components of the self-cleaning toilet cleaner 100. For example, in some implementations, the fluid pumps 190 may be any suitable type of pump. In some implementations, the fluid pumps 190 may be any suitable configuration of pump.

In some implementations, the fluid pumps 190 may be at any suitable position on the housing 110. For example, as shown in FIG. 32, in some implementations, the fluid pumps 190 may be positioned to connect between the reservoir 120, the exterior brushes 140, the bowl brushes 150, the lid brushes 160, the seat brushes 170, and/or the bowl of a toilet 10. In some implementations, the fluid pumps 190 may be positioned to connect between any other suitable components of the self-cleaning toilet cleaner 100.

In some implementations, the fluid pumps 190 are configured to pump and/or vacuum fluid between any suitable components of the self-cleaning toilet cleaner 100. In some implementations, the fluid pumps 190 may be configured to provide any other suitable features of the self-cleaning toilet cleaner 100.

In some implementations, the one or more blowers 200 may comprise any suitable components that can blow, circulate, or otherwise move air within the housing 110 of the self-cleaning toilet cleaner 100. For example, in some implementations, the blowers 200 may be any suitable type of blower, fan, or similar mechanism. In some implementations, the blowers 200 may be any suitable configuration of blower, fan, or similar mechanism.

In some implementations, the blowers 200 may be at any suitable position on the housing 110. For example, as shown in FIGS. 5 and 44, in some implementations, the blowers 200 may be positioned to blow, circulate, or otherwise move air on to a toilet 10 enclosed within the self-cleaning toilet cleaner 100.

In some implementations, the blowers 200 are configured to blow, circulate, or otherwise move air on to a toilet 10 enclosed within the self-cleaning toilet cleaner 100. In some implementations, the blowers 200 may be configured to provide any other suitable features of the self-cleaning toilet cleaner 100.

In some implementations, the operation pad 210 may comprise any suitable components that can indicate and/or control the operation of the self-cleaning toilet cleaner 100. For example, as shown in FIGS. 2 and 18, in some implementations, the operation pad 210 may comprise one or more operation buttons or keys 211. In some implementations, the operation pad 210 may comprise one or more indicator lights 212.

In some implementations, the operation pad 210 may be any suitable size. In some implementations, the operation pad 210 may be any suitable shape. In some implementations, the operation pad 210 may have any other suitable configuration.

In some implementations, the operation pad 210 may be at any suitable position on the housing 110. For example, as shown in FIG. 2, in some implementations, the operation pad 210 may be positioned on the front side of the housing 110 adjacent to the top side of the housing 110.

In some implementations, the operation keys 211 may be configured to allow a user to select the operation of the self-cleaning toilet cleaner 100, such as start, rinse, dry, or stop. In some implementations, the indicator lights 212 may be configured to indicate the operation of the self-cleaning toilet cleaner 100, such as start, rinse, dry, or stop.

In some implementations, the operation pad 210 may be configured to provide any other suitable feature of the self-cleaning toilet cleaner 100.

In some implementations, the one or more operation motors may comprise any suitable components that can mechanically, pneumatically, or otherwise operate one or more suitable components of the self-cleaning toilet cleaner 100. For example, in some implementations, the operation motors may be any suitable type of motor. In some implementations, the operation motors may be any suitable configuration of motor.

In some implementations, the operation motors may be at any suitable position on the housing 110. For example, in some implementations, the operation motors may be positioned respectively adjacent to the toilet opener 130, exterior brushes 140, the bowl brushes 150, the lid brushes 160, the seat brushes 170, the fluid pumps 190, and/or the blowers 200.

In some implementations, the operation motors may be positioned respectively adjacent to any other suitable operable components of the self-cleaning toilet cleaner 100.

In some implementations, the operation motors are configured to mechanically, pneumatically, or otherwise operate one or more suitable components of the self-cleaning toilet cleaner 100. In some implementations, the operation motors may be configured to provide any other suitable features of the self-cleaning toilet cleaner 100.

In some implementations, the one or more sensors may comprise any suitable components that can sense the position, proximity, or other suitable condition of one or more suitable components of the self-cleaning toilet cleaner 100. For example, in some implementations, the sensors may be any suitable type of sensor. In some implementations, the sensors may be any suitable configuration of sensor.

In some implementations, the sensors may be at any suitable position on the housing 110. For example, in some implementations, the sensors may be positioned respectively adjacent to the toilet opener 130, exterior brushes 140, the bowl brushes 150, the lid brushes 160, the seat brushes 170, the fluid pumps 190, and/or the blowers 200. In some implementations, the sensors may further be positioned to sense the position, proximity, or other suitable condition of a toilet cleaned by the self-cleaning toilet cleaner 100.

In some implementations, the sensors may be positioned respectively adjacent to any other suitable operable components of the self-cleaning toilet cleaner 100.

In some implementations, the sensors are configured to sense the position, proximity, or other suitable condition of one or more suitable components of the self-cleaning toilet cleaner 100. In some implementations, the sensors are configured to sense such conditions to assist the operation of the self-cleaning toilet cleaner 100, such as the positioning and/or operation of one or more of the components of the self-cleaning toilet cleaner 100.

In some implementations, the sensors may be configured to provide any other suitable features of the self-cleaning toilet cleaner 100.

In some implementations, the computer system may comprise any suitable components that can implement, execute, perform, or otherwise control and/or monitor one or more components and/or functions of the self-cleaning toilet cleaner 100. For example, in some implementations, the computer system may comprise any suitable computer system, such as a system-on-chip (SOC) computer system or a single-board computer system (SBC).

In some implementations, the computer system is configured to implement, execute, perform, or otherwise control and/or monitor one or more components and/or functions of the self-cleaning toilet cleaner 100, such as which are described herein.

In some implementations, the self-cleaning toilet cleaner 100 is configured to automatically clean or self-clean a toilet 10.

In some implementations, the self-cleaning toilet cleaner 100 is configured to automatically clean or self-clean one or more portions of a toilet 10, such as the outer or exterior surfaces, the toilet lid, the toilet seat, and/or the toilet bowl. In some implementations, the self-cleaning toilet cleaner 100 is configured to automatically clean or self-clean all of the portions of a toilet 10.

In some implementations, the self-cleaning toilet cleaner 100 is configured to at least partly encapsulate or enclose a toilet 10 to self-clean the toilet. In some implementations, the self-cleaning toilet cleaner 100 is configured to fully encapsulate or enclose a toilet 10 to self-clean the toilet 10.

In some implementations, the self-cleaning toilet cleaner 100 may suitably comprise any one or more of the above described components, such as in any suitable combination, permutation, etc., which will be understood by one skilled in the art in accordance with the present disclosure.

In some implementations, the self-cleaning toilet cleaner 100 comprises any suitable dimensions. For example, in some implementations, the housing 110 comprises dimensions to enclose or encapsulate a toilet 10 as described above. In some implementations, the housing 110 comprises dimensions to fit within a bathroom, toilet stall, or other suitable area to encapsulate a toilet 10 as described above.

In some implementations, the housing 110 may comprise a first dimension, such as a width, of 20 inches. In some implementations, the first dimension may be more than 20 inches. In some implementations, the first dimension may be less than 20 inches.

In some implementations, the housing 110 may comprise a second dimension, such as a length, of 30 inches. In some implementations, the second dimension may be more than 30 inches. In some implementations, the second dimension may be less than 30 inches.

In some implementations, the housing 110 may comprise a third dimension, such as a height, of 35 inches. In some implementations, the third dimension may be more than 35 inches. In some implementations, the third dimension may be less than 35 inches.

In some implementations, the housing 110 may comprise any other suitable dimensions.

In some implementations, the self-cleaning toilet cleaner 100 is composed of any suitable materials. For example, in some implementations, the housing 110 may be composed of a material that allows the housing 110 to be resizable and/or allows the self-cleaning toilet cleaner 100 to clean a toilet 10.

In some implementations, the material may be at least partly a plastic material that can be retracted, stretched, and/or locked in place. In some implementations, the plastic material may be a molded plastic material such as Bakelite.

In some implementations, the material may allow the housing 110 to minimize and/or prevent splatter, leakage, etc. during operation of the self-cleaning toilet cleaner 100 to clean a toilet 10.

In some implementations, the housing 110 may further be at least partly composed of a rubber material, such as that forms one or more rubber seals that prevent leakage from the housing 110 during the operation of the self-cleaning toilet cleaner 100.

In some implementations, the housing 110 may be composed of any other suitable material.

As another example, in some implementations, the exterior brushes 140, the bowl brushes 150, the lid brushes 160, and/or the seat brushes 170 may be composed of a nylon material. In some implementations, the brushes 140, 150, 160, 170 may be composed of any other suitable material.

In some implementations, the self-cleaning toilet cleaner 100 can have any suitable appearance, such as the examples shown in the figures.

Figure 27:
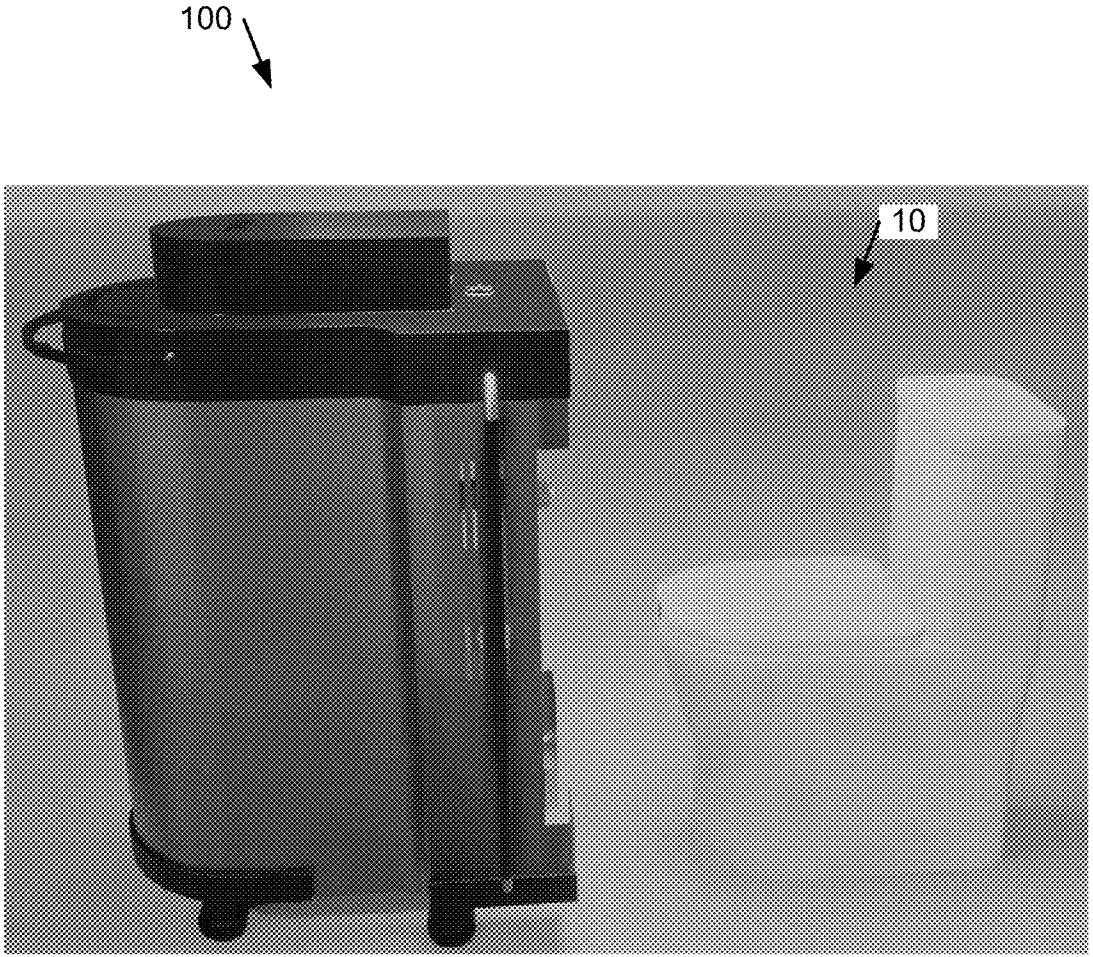
FIGS. 27-46 illustrate example use and operation of the self-cleaning toilet cleaner according to the present disclosure.

In some implementations, an example method of using the self-cleaning toilet cleaner 100, with respect to the above-described figures, comprises moving the self-cleaning toilet cleaner 100 over and around a toilet 10, such as shown in FIGS. 27-29.

In some implementations, the self-cleaning toilet cleaner 100 may be moved around the toilet 10 across a floor or other surface using the wheels 113. In some implementations, the self-cleaning toilet cleaner 100 may be moved around the toilet 10 by pushing or otherwise moving the self-cleaning toilet cleaner 100 using the handle 114.

In some implementations, the bumpers 115 may prevent the housing 110 from damaging an adjacent wall or other object while moving the self-cleaning toilet cleaner 100.

In some implementations, the method comprises starting the automatic cleaning or self-cleaning operation of the self-cleaning toilet cleaner 100. In some implementations, the operation may be started by selecting the corresponding key 211 on the operation pad 210. In some implementations, the operation of the self-cleaning toilet cleaner 100 may be indicated by an indicator light 212 on the operation pad 210.

Figure 46:
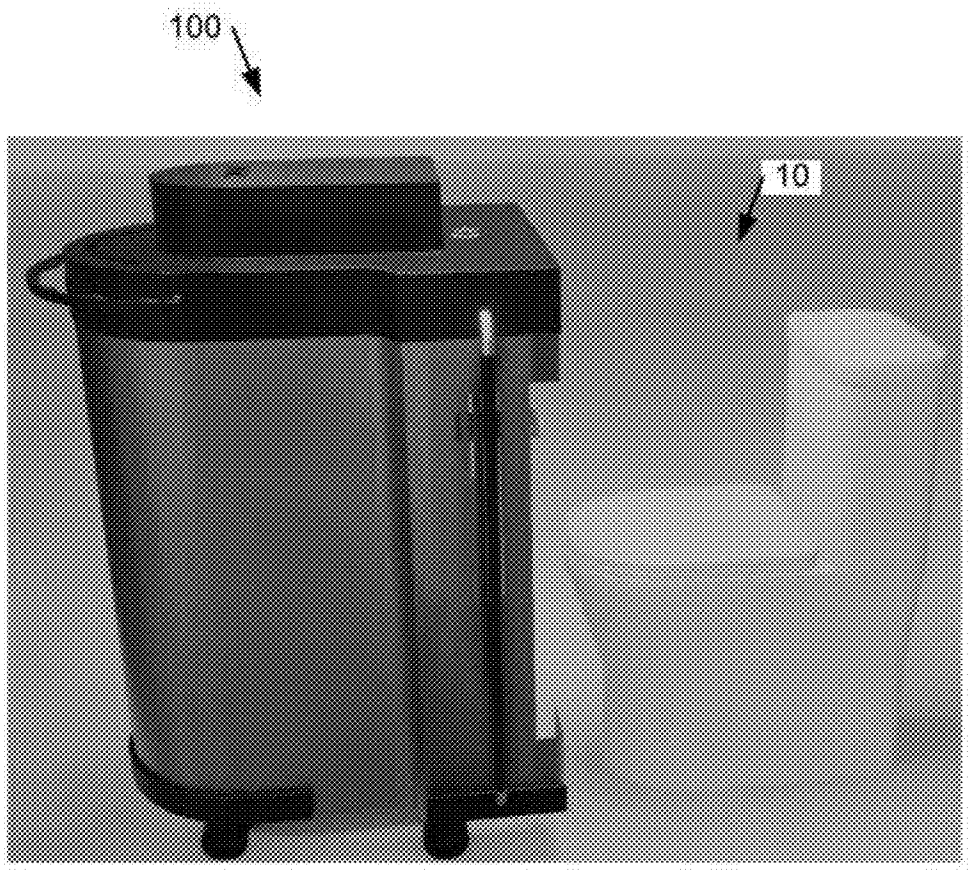

In some implementations, the method comprises removing the self-cleaning toilet cleaner 100 from around the toilet 10 after the cleaning operation by the self-cleaning toilet cleaner 100, such as show in FIGS. 45 and 46.

In some implementations, the self-cleaning toilet cleaner 100 may be removed from around the toilet 10 across a floor or other surface using the wheels 113. In some implementations, the self-cleaning toilet cleaner 100 may be removed from around the toilet 10 by pulling or otherwise moving the self-cleaning toilet cleaner 100 using the handle 114.

In some implementations, the method may further comprise adding a cleaning solution or other fluid to the reservoir 120 through the fluid opening 111.

In some implementations, the method may further comprise selecting another operation of the self-cleaning toilet cleaner 100 such rinse, dry, or stop by selecting a corresponding key 211 on the operation pad 210.

In some implementations, an example method of operation of the self-cleaning toilet cleaner 100, with respect to the above-described figures, comprises receiving a toilet 10 into the housing 10, such as shown in FIGS. 28 and 29. In some implementations, the toilet 10 may be received through the opened door 112.

In some implementations, the method comprises starting the automatic cleaning or self-cleaning operation of the self-cleaning toilet cleaner 100. In some implementations, the operation may be started in response to a user selecting a corresponding key 211 on the operation pad 210. In some implementations, the operation may be started automatically after the self-cleaning toilet cleaner 100 senses receiving the toilet 10 into the housing 110.

In some implementations, a corresponding indicator light 212 on the operation pad 210 may light to indicate the cleaning operation is started.

In some implementations, the door 112 is closed at or before the start of the cleaning operation of the self-cleaning toilet cleaner 100.

In some implementations, the method may comprise the exterior brushes 140 moving one or more times in a downward and/or upward motion along the exterior surface of the toilet 10 to clean the surface, such as shown in FIGS. 32-34. In some implementations, the exterior brushes 140 may also rotate.

In some implementations, a fluid, such as a cleaning solution, may be applied to the exterior surface of the toilet 10 while the exterior brushes 140 scrub the surface. In some implementations, the fluid may be applied from the reservoir 120 through the fluid lines 180 by the fluid pumps 190.

Figure 35:
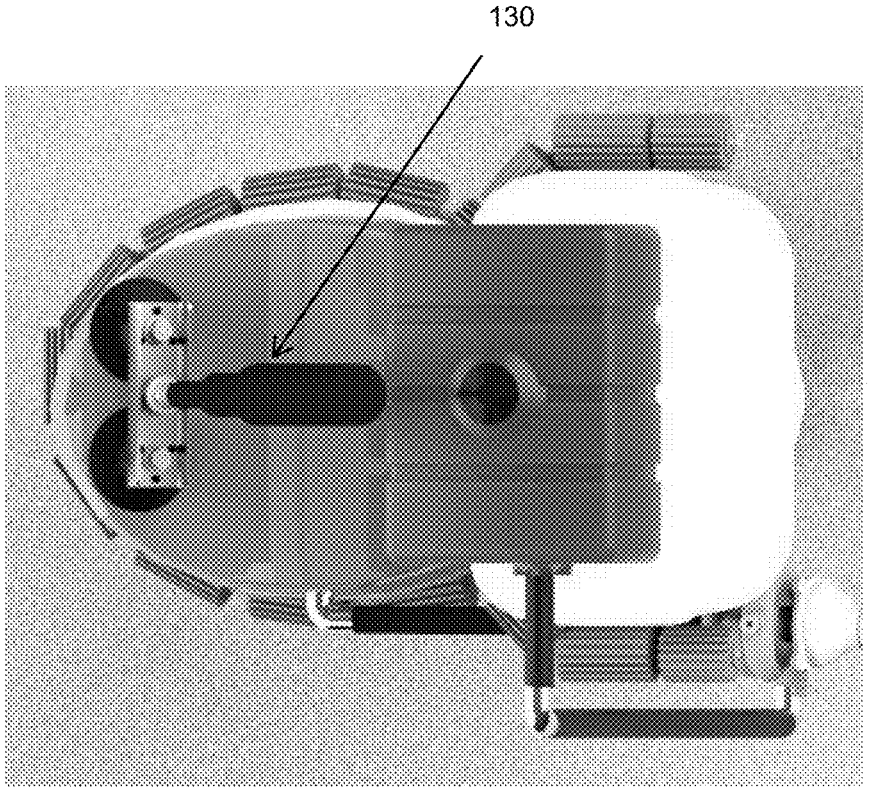
Figure 36:
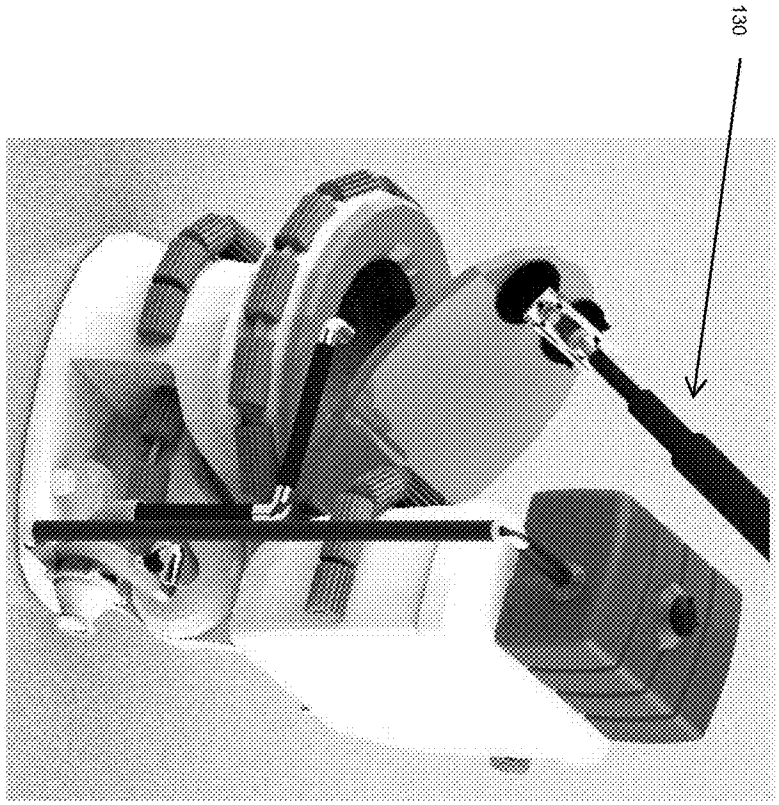
Figure 37:
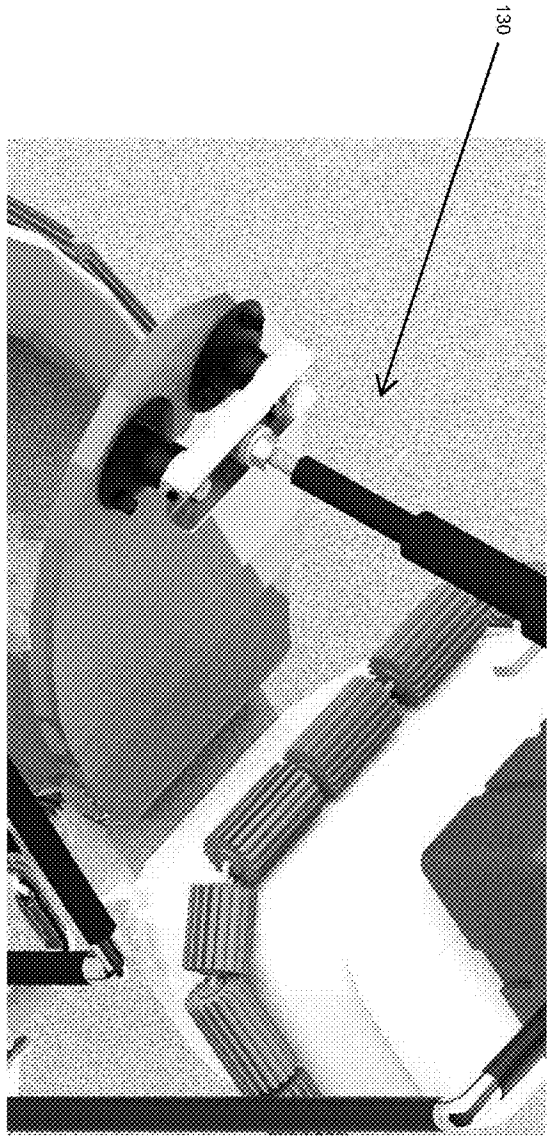

In some implementations, the method may comprise the self-cleaning toilet cleaner 100 at least partly opening the toilet 10 by the toilet opener 130 raising the lid and/or seat of the toilet 10, such as shown in FIGS. 35-37. In some implementations, the extension portion 131 extends from the dome portion 116 of the housing 110 to engage the attachment portion 132 to the lid and/or seat of the toilet 10.

In some implementations, the extension portion 131 retracts to the dome portion 116 such that the engaged attachment portion 132 at least partly lifts the lid and/or seat of the toilet 10.

In some implementations, the method may comprise the lid brushes 160 and/or the seat brushes 170 moving one or more times back and forth along the lid and/or seat of the toilet 10 respectively to clean the lid and/or seat. In some implementations, the lid brushes 160 and/or the seat brushes 170 may also rotate.

In some implementations, a fluid, such as a cleaning solution, may be applied to the lid and/or seat of the toilet 10 while the lid brushes 160 and/or the seat brushes 170 scrubs the lid and/or seat respectively. In some implementations, the fluid may be applied from the reservoir 120 through the fluid lines 180 by the fluid pumps 190.

In some implementations, the lid brushes 160 and/or the seat brushes 170 may complete the lifting of the lid and/or seat of the toilet 10 respectively to fully open the toilet 10 to allow access to the bowl of the toilet 10 for cleaning.

In some implementations, the method may comprise the bowl brushes 150 positioning within and cleaning the bowl of the toilet 10. In some implementations, the extension portion 151 extends from the dome portion 116 of the housing 110 to position the brush portion 152 within the toilet bowl. In some implementations, the bowl brushes 150 rotates or otherwise moves within the bowl of the toilet 10 to clean the bowl.

In some implementations, a fluid, such as a cleaning solution, may be applied to the toilet bowl while the bowl brushes 150 scrubs the bowl. In some implementations, the fluid may be applied from the reservoir 120 through the fluid lines 180 by the fluid pumps 190.

In some implementations, the method may comprise the self-cleaning toilet cleaner 100 removing the bowl brushes 150 from within the toilet bowl. In some implementations, the extension portion 151 retracts to the dome portion 116 such that the brush portion 152 is removed from within the toilet bowl. In some implementations, the bowl brushes 150 is retracted such that the extension portion 151 and/or the brush portion 152 are at least partly positioned in the dome portion 116 of the housing 110.

In some implementations, the method may comprise the self-cleaning toilet cleaner 100 rinsing one or more portions of the toilet 10. In some implementations, a fluid, such as clean water, is applied to rinse the one or more portions of the toilet 10. In some implementations, the fluid may be applied from a reservoir 120 through the fluid lines 180 by the fluid pumps 190.

In some implementations, dirty water from the rinse operation may be removed through the fluid lines 180 by the fluid pumps 190, such by vacuuming and pumping the dirty water into the toilet for draining and/or flushing.

In some implementations, the rinse operation may be started automatically. In some implementations, the rinse operation may be started in response to a user selecting a corresponding key 211 on the operation pad 210.

In some implementations, a corresponding indicator light 212 on the operation pad 210 may light during the rinse operation of the self-cleaning toilet cleaner 100.

In some implementations, the method may comprise the self-cleaning toilet cleaner 100 drying one or more portions of the toilet 10. In some implementations, the blower 200 may operate to blow, circulate, or otherwise move air on the one or more portions of the toilet 10 to dry the portions.

In some implementations, the dry operation may be started automatically. In some implementations, the dry operation may be started in response to a user selecting a corresponding key 211 on the operation pad 210.

In some implementations, a corresponding indicator light 212 on the operation pad 210 may light during the dry operation of the self-cleaning toilet cleaner 100.

In some implementations, the method may comprise the self-cleaning toilet cleaner 100 ending or stopping the cleaning operation of the toilet 10. In some implementations, the door 112 may be opened to allow the self-cleaning toilet cleaner 100 to be removed from around the toilet 10.

In some implementations, the cleaning operation may be stopped automatically. In some implementations, the cleaning operation may be stopped in response to a user selecting a corresponding key 211 on the operation pad 210.

In some implementations, a corresponding indicator light 212 on the operation pad 210 may light to indicate the cleaning operation is stopped or ended.

In some implementations, the above described method of operation and/or method of use may be implemented, executed, performed, or otherwise controlled and/or monitored by a computer system, such as the above described computer system.

The figures, including photographs and drawings, comprised herewith may represent one or more implementations of the self-cleaning toilet cleaner 100.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A self-cleaning toilet cleaner comprising:

a housing, a water reservoir, and one or more brushes wherein:

the housing is portable having wheels and a handle attached to the housing and wherein the housing comprises a width of 20 inches or less, a length of 30 inches or less, and a height of 35 inches of less such that the housing may be moved from one location to another location;

the housing comprising a front sidewall, a back sidewall opposite the front sidewall, left sidewall, and a right sidewall opposite the left sidewall wherein the back sidewall is retractable, wherein the front sidewall, back sidewall, left sidewall and right sidewall are configured such that the housing encapsulates a toilet comprising a tank, a bowl, a seat having a lid, and a base such that the tank, the bowl, the seat having a lid, and the base are enclosed in the housing and surrounded by the sidewalls and wherein the housing is configured to house the water reservoir and the one or more brushes;

the water reservoir is configured to store water to be used for cleaning the toilet; and the one or more brushes are configured to clean at least a portion of the outer surface of the toilet wherein the brushes are operatively connected to the water reservoir via one or more fluid lines such that water dispenses from the brushes and wherein the one or more brushes are configured to position adjacent to the surface of the toilet and move to clean the surface of toilet.

2. The self-cleaning toilet cleaner of claim 1 wherein the brushes are configured to clean the outer surface of the tank.

3. The self-cleaning toilet cleaner of claim 1 wherein the brushes are configured to clean the outer surface of the bowl.

4. The self-cleaning toilet cleaner of claim 1 wherein the brushes are configured to clean the base of the toilet.

5. The self-cleaning toilet cleaner of claim 1 further comprising one or more bowl brushes configured to clean inside the toilet bowl wherein the bowl brushes are positioned in the top of the housing and configured to drop down inside the toilet bowl.

6. The self-cleaning toilet cleaner of claim 1 further comprising a lid opener configured to lift the lid of the toilet.

7. The self-cleaning toilet cleaner of claim 1 further comprising a seat opener configured to lift the seat of the toilet.

8. The self-cleaning toilet cleaner of claim 1 further comprising sensors to position the brushes.

9. The self-cleaning toilet cleaner of claim 1 further comprising a blower to dry the toilet.

10. The self-cleaning toilet cleaner of claim 1 further comprising fluid lines for routing dirty water to the toilet bowl.

11. The self-cleaning toilet cleaner of claim 1 further comprising computer readable medium with instruction that when operable on the computer readable medium causes the self-cleaning toilet cleaner to self-wash the toilet including positioning the one or more brushes and controlling the flow of water.

12. The self-cleaning toilet cleaner of claim 1 further comprising a plurality of brushes configured to clean the outer surface of the tank, the outer surface of the bowl, the base, the interior of the bowl, the lid, and the seat.

13. A self-cleaning toilet cleaner comprising:

a housing, a water reservoir, and one or more brushes wherein:

the housing is portable having wheels and a handle attached to the housing;

the housing comprises a front sidewall, a back sidewall opposite the front sidewall, left sidewall, and a right sidewall opposite the left sidewall wherein the back sidewall is retractable, wherein the front sidewall, back sidewall, left sidewall and right sidewall are configured such that the housing encapsulates a toilet comprising a tank, a bowl, a seat having a lid, and a base such that the tank, the bowl, the seat having a lid, and the base are enclosed in the housing and surrounded by the sidewalls and wherein the housing is configured to house the water reservoir and the one or more brushes;

the water reservoir is configured to store water to be used for cleaning the toilet; and the one or more brushes are configured to clean at least a portion of the outer surface of the toilet wherein the brushes are operatively connected to the water reservoir via one or more fluid lines such that water dispenses from the brushes and wherein the one or more brushes are configured to position adjacent to the surface of the toilet and move to clean the surface of toilet wherein the brushes are configured to clean the outer surface of the tank, the outer surface of the bowl, the base, the interior of the bowl, the lid, and the seat; wherein the bowl brushes are positioned in the top of the housing and configured to drop down inside the toilet bowl;

a toilet opener configured to lift the lid of the toilet and the seat of the toilet;

sensors to position the brushes;

a blower to dry the toilet; and computer readable medium with instruction that when operable on the computer readable medium causes the self-cleaning toilet cleaner to self-wash the toilet including positioning the one or more brushes and controlling the flow of water.

14. A method of using the self-cleaning toilet cleaner of claim 1, the method comprising:

retracting the back sidewall up so that the cleaner can receive a toilet;

moving the housing on its wheels over and around a toilet through the opening created by retracting the back sidewall retracting the back sidewall down to encapsulate the toilet; and automatically cleaning the toilet using the one or more brushes; and retracting the back sidewall up and removing the housing from over the toilet.

* * * * *